US007963634B2

(12) United States Patent
Yokouchi

(10) Patent No.: US 7,963,634 B2
(45) Date of Patent: Jun. 21, 2011

(54) LIQUID EJECTION HEAD, LIQUID EJECTION APPARATUS AND METHOD OF MANUFACTURING LIQUID EJECTION HEAD

(75) Inventor: Tsutomu Yokouchi, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 259 days.

(21) Appl. No.: 12/205,594

(22) Filed: Sep. 5, 2008

(65) Prior Publication Data

US 2009/0079797 A1 Mar. 26, 2009

(30) Foreign Application Priority Data

Sep. 21, 2007 (JP) ..... 2007-246173

(51) Int. Cl.
*B41J 2/04* (2006.01)

(52) U.S. Cl. ..... 347/54

(58) Field of Classification Search ..... 347/54, 347/50, 57–59, 61–65, 40, 44, 20
See application file for complete search history.

(56) References Cited

U.S. PATENT DOCUMENTS

| | | | | |
|---|---|---|---|---|
| 6,007,187 | A * | 12/1999 | Kashino et al. | 347/65 |
| 2002/0021337 | A1 | 2/2002 | Sugiyama et al. | |
| 2005/0046672 | A1 * | 3/2005 | Cabal et al. | 347/54 |

FOREIGN PATENT DOCUMENTS

| | | | | |
|---|---|---|---|---|
| JP | 62094347 | * | 4/1987 | 347/61 |
| JP | 11-48483 | A | 2/1999 | |
| JP | 2002-113871 | A | 4/2002 | |
| JP | 2004-155203 | A | 6/2004 | |

* cited by examiner

*Primary Examiner* — K. Feggins
(74) *Attorney, Agent, or Firm* — Birch, Stewart, Kolasch & Birch, LLP

(57) ABSTRACT

A liquid ejection head includes: an ejection port through which liquid is ejected; a liquid chamber which is connected to the ejection port, the liquid chamber being filled with the liquid; a pressurization device which is arranged on a wall of the liquid chamber, the pressurization device pressurizing the liquid in the liquid chamber; and a movable member which has a free end on a side of the ejection port and a fixed end on a side opposite to the ejection port, the free end being arranged at a prescribed distance from the wall of the liquid chamber so as to face the wall of the liquid chamber, the movable member including a first layer that is an internal layer, and second and third layers that are respectively arranged on both surfaces of the first layer, the second and third layers having a stress lower than the first layer.

17 Claims, 35 Drawing Sheets

FIG.3

| STRESS DIFFERENTIAL OF FILM (MPa) | EFFECT |
|---|---|
| 10 | BREAKING OF MOVABLE MEMBER, NO EFFECT OF PREVENTING ADVANCE OF CRACKS |
| 50 | NO BREAKING OF MOVABLE MEMBER |
| 100 | NO BREAKING OF MOVABLE MEMBER |
| 500 | NO BREAKING OF MOVABLE MEMBER |
| 1000 | BREAKING OF MOVABLE MEMBER, DETACHMENT BETWEEN FILMS |

FIG.4

| TYPE OF BATH | pH | ELECTRODEPOSITION STRESS ($kg/mm^2$) | HARDNESS (Hv) | TENSILE STRENGTH ($kg/mm^2$) | EXTENSION (%-5cm) |
|---|---|---|---|---|---|
| ALL CHLORIDES | 3.0 | 29.5 | 244 | 71.8 | 14 |
| WATTS BATH | 3.0 | 12.0 | 150 | 39.4 | 28 |
| WATTS BATH + ADDITIVE | 4.0 | -3.5 | 500 | - | - |
| ALL SULFURIC ACID | 3.0 | 12.0 | 202 | 46.4 | 20 |
| BOROFLUORIDE SALT | 2.6 | 10.6 | 128 | 40.3 | 32 |
| SULFAMINE ACID SALT | 2.0 | 5.6 | 150 | 38.7 | 30 |
| SULFAMINE ACID SALT + STRESS REDUCING AGENT | 4.0 | -3.5 | 500 | - | - |

LIQUID EJECTION HEAD, LIQUID EJECTION APPARATUS AND METHOD OF MANUFACTURING LIQUID EJECTION HEAD

BACKGROUND OF THE INVENTION

1. Field of the Invention

The present invention relates to a liquid ejection head, a liquid ejection apparatus and a method of manufacturing a liquid ejection head, and more particularly, to a structure for improving the durability of the liquid ejection head and a method of manufacturing the liquid ejection head having the above-described structure.

2. Description of the Related Art

In general, an inkjet recording apparatus which forms a desired image by ejecting ink droplets from a liquid ejection head onto a recording medium has been widely used as a generic image forming apparatus. In inkjet recording apparatuses, various innovations have been applied to the structure and shape of the flow channels inside the liquid ejection head in order to achieve high-speed ejection by improving the ejection efficiency and improving the refilling efficiency.

Japanese Patent Application Publication No. 2002-113871, Japanese Patent Application Publication No. 11-048483 and Japanese Patent Application Publication No. 2004-155203 describe a liquid ejection head of a thermal type, having a structure which comprises a movable member that faces a heating body at a spacing interval from the heating body. The movable member of the liquid ejection head described in Japanese Patent Application Publication No. 2002-113871, Japanese Patent Application Publication No. 11-048483 and Japanese Patent Application Publication No. 2004-155203 is formed in a cantilever structure, one end thereof being fixed to a step section provided to the upstream side of the ink chamber (the side of the common liquid chamber), and the other end thereof, which is on the downstream side of the ink chamber (the side of the ejection port) being formed as a free end. When an air bubble is created in the vicinity of the heating body by a film boiling effect, the free end of the movable member which is provided at a position opposing the heating body deforms so as to open widely toward the ejection port side, and hence the direction of propagation of the pressure produced by the creation of the bubble is guided toward the downstream direction, and the pressure of the bubble contributes directly and efficiently to ejection. Furthermore, the actual growth of the air bubble is guided toward the downstream direction, similarly to the direction of propagation of the pressure, and the bubble grows larger in the downstream side of the movable member than in the upstream side of the movable member. In other words, the liquid ejection head described in Japanese Patent Application Publication No. 2002-113871, Japanese Patent Application Publication No. 11-048483 and Japanese Patent Application Publication No. 2004-155203 is able to improve the fundamental ejection characteristics, such as the ejection efficiency, the ejection force, the ejection speed, and the like, by controlling the actual growth direction of the bubble and controlling the propagation of the pressure of the bubble by means of the deformation of the movable member.

However, the movable member provided in the liquid ejection head described in Japanese Patent Application Publication No. 2002-113871, Japanese Patent Application Publication No. 11-048483 and Japanese Patent Application Publication No. 2004-155203 is displaced by several micrometers to several ten micrometers every time a bubble is created by the heater, and therefore a large stress is generated repeatedly in the movable member and problems such as deformation or breaking of the movable member occur.

In the liquid ejection head described in Japanese Patent Application Publication No. 2002-113871, right-angled sections, acute-angled sections, burrs, and the like formed at the edges of the movable member, are removed, thereby alleviating the concentration of stress, and hence the occurrence of cracks in the movable member or breaking of the movable member is prevented to some extent. However, small cracks do occur in the movable member due to the repeated deformation, and no countermeasures are provided for preventing breakage of the movable member due to these small cracks.

Japanese Patent Application Publication No. 11-048483 discloses technology for covering a movable member with a coating, from the viewpoint of improving resistance to corrosion by the liquid and preventing electrical corrosion. However, countermeasures are not proposed for preventing the deformation of the movable member or the breaking of the movable member as a result of the repeated stress applied to the movable member during the ejection of liquid.

In the liquid ejection head described in Japanese Patent Application Publication No. 2004-155203, a movable member is constituted by laminated layers of metals having different stresses (tensile stress and compressive stress), with the aim of achieving highly accurate positioning of the movable member, controlling the thickness of the movable member and reducing the deformation energy created by forming the member so as to adopt a warped state. On the other hand, Japanese Patent Application Publication No. 2004-155203 does not mention the fact that a repeated stress is applied to the movable member by the ejection of liquid, and the liquid ejection head described in Japanese Patent Application Publication No. 2004-155203 does not propose countermeasures against the deformation of the movable member or the breaking of the movable member as a result of this stress.

SUMMARY OF THE INVENTION

The present invention has been contrived in view of these circumstances, an object thereof being to provide a liquid ejection head, a liquid ejection apparatus, and a method of manufacturing a liquid ejection head, whereby the durability with respect to repeated stress of a moveable member which is arranged in the liquid ejection head in order to enhance ejection efficiency can be improved.

In order to attain the aforementioned object, the present invention is directed to a liquid ejection head, comprising: an ejection port through which liquid is ejected; a liquid chamber which is connected to the ejection port, the liquid chamber being filled with the liquid; a pressurization device which is arranged on a wall of the liquid chamber, the pressurization device pressurizing the liquid in the liquid chamber; and a movable member which has a free end on a side of the ejection port and a fixed end on a side opposite to the ejection port, the free end being arranged at a prescribed distance from the wall of the liquid chamber so as to face the wall of the liquid chamber; the movable member including a first layer that is an internal layer, and second and third layers that are respectively arranged on both surfaces of the first layer, the second and third layers having a stress lower than the first layer.

In this aspect of the present invention, the first layer which forms the internal layer of the movable member has a structure which is interposed between the second layer and the third layer which have a lower stress than the first layer, and therefore the second layer and the third layer have a compressive stress with respect to the first layer. Therefore, even if cracks appear in the second layer and the third layer which form the surface layer of the movable member, then these cracks do not advance into the movable member and the durability of the movable member increases.

In the present specification, "compressive stress" and "tensile stress" are determined by the relative magnitude of the stress of a reference layer and the stresses of the other layers, in a laminated structure which is made of a plurality of layers. For example, in a laminated structure in which a second layer is laminated onto one surface of a first layer and a third layer is laminated onto the other surface of the first layer, then if the following relationships are satisfied: (stress of first layer)> (stress of second layer), (stress of first layer)>(stress of third layer), the stresses of the second layer and the third layer are considered to be "compressive stress" with respect to the stress of the first layer, and on the other hand, the stress of the first layer is considered to be "tensile stress" with respect to the stresses of the second and third layers.

Preferably, the stress of the first layer is a tensile stress, and the stress of the second and third layers is a compressive stress.

In this aspect of the present invention, the stresses of the first to third layers measured independently satisfy conditions that the stress of the first layer is a tensile stress, and the stresses of the second and third layers are compressive stresses. Therefore, the stress differential between the first layer and the second layer or between the first layer and the third layer can be made greater, and the effect in preventing the advance of cracks is further enhanced.

Preferably, the first layer of the movable member is embedded in the second and third layers.

If the first layer is exposed on the surface, then there is a concern that cracks may arise from the exposed portions. Furthermore, if the first layer, and the second layer and third layer are made of different metals, then there is a concern that corrosion (electrical corrosion) may occur. In the above aspect of the present invention, since the first layer is covered by the second layer and the third layer (i.e., the first layer is embedded in the second and third layers), then the occurrence of cracks or corrosion in the movable member is prevented.

Preferably, the stress in the second and third layers decreases from a side of the first layer toward a side opposite to the first layer.

In this aspect of the present invention, abrupt change in the stress between the layers can be suppressed by adopting a composition in which the stress of the second layer and the third layer gradually decreases from the inside (i.e., a side of the internal layer) toward the outside (i.e., a side opposite to the internal layer), whereby interlayer peeling between the first layer and the second layer, and between the first layer and the third layer can be prevented.

Preferably, at least one of the second and third layers includes a plurality of layers that are stacked together, adjacent two layers of the plurality of layers satisfying conditions that one of the adjacent two layers farther from the first layer has a stress lower than the other of the adjacent two layers nearer to the first layer.

In this aspect of the present invention, the second layer and the third layer have a structure in which the stress becomes gradually lower from the interior of the movable member toward the surface thereof, and therefore it is possible to reduce the stress differential in the bonding region (including the interface between the first and second layers) between the first layer and the second layer, and the stress differential in the bonding region (including the interface between the first and third layers) between the first layer and the third layer, while ensuring sufficient stress differential between the first layer and the second layer, and sufficient stress differential between the first layer and the third layer. By this means, interlayer peeling between the first layer and the second layer, and between the first layer and the third layer can be prevented.

It is also possible to adopt a laminated composition (in which a plurality of layers are stacked) only for the second layer, or to adopt a laminated composition only for the third layer. Furthermore, it is also possible to use a laminated composition for both the second layer and the third layer.

Preferably, a surface of the movable member that makes contact with the liquid in the liquid chamber is covered with a liquid resistant film.

In this aspect of the present invention, the corrosion of the movable member by the liquid inside the liquid chamber is prevented.

Preferably, one of the second and third layers that is nearer to the wall on which the pressurization device is arranged has a stress greater than the other of the second and third layers; and the free end of the movable member bends toward the wall on which the pressurization is arranged, in an initial state.

In this aspect of the present invention, by making the free end of the movable member bend forcibly in one direction (causing the free end to bend toward the side of the wall where the pressurization device is arranged), it is possible to ensure an equal (uniform) initial position (static position) of the movable member, and therefore variations in the ejection characteristics of the movable member can be suppressed.

This aspect of the present invention displays beneficial results particularly when a plurality of movable members are arranged in one head (i.e., a plurality of nozzles are arranged in one head).

Preferably, one of the second and third layers that is nearer to the wall on which the pressurization device is arranged has a structure in which the stress decreases from a side of the free end toward a side of the fixed end.

In this aspect of the present invention, by arranging a layer in which the stress decreases from a side of the free end toward a side of the fixed end, on a side of the first layer adjacent to the wall (the layer on the lower side) where the pressurization device is arranged, the free end side of the movable member becomes able to move more readily, and it is also possible to raise the durability of the base portion of the movable member where cracks are liable to occur (the boundary between the fixed portion and the movable portion). By this means, it is possible to enhance the performance of the movable member and to improve the durability of the movable member.

In order to form a layer in which the stress decreases from a side of the free end toward a side of the fixed end, it is possible to increase the thickness of the layer from the free end side toward the fixed end side, and it is also possible to keep the thickness of the layer uniform but to change the stress by varying the film formation conditions.

Preferably, the above-described liquid ejection head further comprises a restricting member which supports a movable portion of the movable member from a side of the wall on which the pressurization device is arranged, the movable portion including the free end of the movable member.

In this aspect of the present invention, the amount of bending of the free end of the movable member (the initial position of the movable member) is uniform, and variation in the characteristics of the movable member due to excessive bending of the free end of the movable member is prevented.

Preferably, the above-described liquid ejection head further comprises a fixing member which is arranged between the fixed end of the movable member and the wall of the liquid chamber, the movable member having a flat-plate shape, the fixed end of the movable member being fixed to the wall by means of the fixing member.

In this aspect of the present invention, the structure of the movable member is simplified, and the film formation conditions of the respective layers remain uncomplicated.

A desirable mode is one in which the fixing member is made of the same material as one of the second layer and the third layer of the movable member, which is bonded to the fixing member.

Preferably, the movable member includes a fixed portion corresponding to the fixed end which is fixed directly to the wall on which the pressurization device is arranged, an inclined portion which rises from the fixed portion toward a side of the free end, and a movable portion which extends from the inclined portion toward the free end, the movable portion being arranged at a prescribed distance from the wall on which the pressurization device is arranged.

In this aspect of the present invention, it is possible to fix the movable member directly to the wall where the pressurization device is arranged, and hence a member for fixing the movable member to the wall is not required between the movable member and the wall.

In order to attain the aforementioned object, the present invention is also directed to a liquid ejection apparatus comprising the above-described liquid ejection head.

The liquid ejection apparatus may include an inkjet recording apparatus (image forming apparatus) which forms a desired image on a recording medium by ejecting ink from nozzles which are arranged in a head.

In order to attain the aforementioned object, the present invention is also directed to a method of manufacturing a liquid ejection head which includes: an ejection port through which liquid is ejected; a liquid chamber which is connected to the ejection port, the liquid chamber being filled with the liquid; a pressurization device which is arranged on a wall of the liquid chamber, the pressurization device pressurizing the liquid in the liquid chamber; and a movable member which has a free end on a side of the ejection port and a fixed end on a side opposite to the ejection port, the free end being arranged at a prescribed distance from the wall of the liquid chamber so as to face the wall of the liquid chamber, the movable member including a first layer that is an internal layer, and second and third layers that are respectively arranged on both surfaces of the first layer, the method comprising the steps of: forming the third layer; then forming the first layer on the third layer on a side opposite to the wall on which the pressurization device is arranged, the first layer having a stress higher than the third layer; and then forming the second layer on the first layer on a side opposite to the third layer, the second layer having a stress lower than the first layer.

A desirable mode is one which includes steps, such as a step of forming the liquid chamber, a step of forming a flow channel, a step of forming the ejection port, a step of forming the pressurization device, and the like.

Preferably, the first to third layers are formed by a thin film formation process including at least one of plating, sputtering and CVD.

In this aspect of the present invention, it is possible to control the stresses of the respective layers, and hence a desirable movable member is formed.

According to the present invention, the first layer which forms the internal layer of the movable member is interposed between the second layer and the third layer which have a lower stress than the first layer, and the second layer and the third layer thus have a compressive stress with respect to the first layer. Therefore, even if cracks appear in the second layer and the third layer which form the surface layer of the movable member, then these cracks do not advance into the movable member and the durability of the movable member increases.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 3 is a diagram showing the results of evaluation of the durability of the movable member in accordance with the stress differential;

FIG. 4 is a diagram which describes the stress of the film formed by plating;

DETAILED DESCRIPTION OF THE PREFERRED EMBODIMENTS

Structure of Liquid Ejection Head

Figure 1:
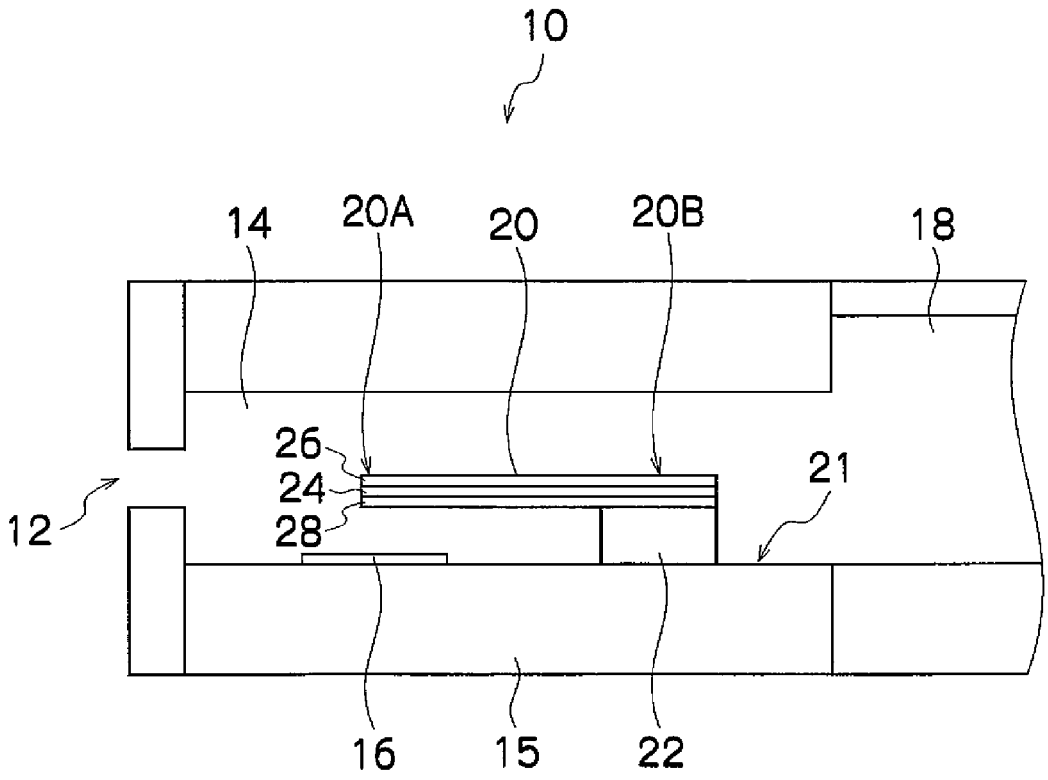
FIG. 1 is a cross-sectional diagram showing the structure of a head according to an embodiment of the present invention.

FIG. 1 is a cross-sectional diagram showing the three-dimensional structure of the liquid ejection head (also called simply "head") 10 according to an embodiment of the present invention. The head 10 according to the present embodiment forms a desired image or pattern on the recording medium by ejecting liquid from a plurality of nozzles; for example, it is an inkjet head of an inkjet recording apparatus which forms a color image on a recording medium by means of colored inks.

The head 10 shown in FIG. 1 comprises: a nozzle 12 which ejects liquid; a liquid chamber 14 which is connected with the nozzle 12 and accommodates the liquid to be ejected from the nozzle 12; a heater 16 which functions as a pressurization device for applying pressure to the liquid in the liquid chamber 14 when the liquid in the liquid chamber 14 is to be ejected from the nozzle 12; and a plate-shaped movable member 20 which is elastic and has a cantilever structure, disposed at a prescribed spacing from the heater 16 so as to oppose the heater 16, the plate-shaped movable member 20 having a fixed end 20B on the side of the common liquid chamber 18 and a free end 20A on the side of the nozzle 12.

A thermal method is used as the ejection method of the head 10 shown in FIG. 1. More specifically, when the liquid inside the liquid chamber 14 is heated by supplying a prescribed current to the heater 16 which is arranged on the bottom surface 21, a gas bubble is created by a film boiling phenomenon, and the liquid inside the liquid chamber 14 is thereby pressurized and caused to be ejected as a liquid droplet from the nozzle 12. Moreover, when the heater 16 generates heat, a gas bubble is generated and grows in the bubble generation region (heating region) between the heater 16 and the movable member 20. Consequently, due to the pressure created by the growth of the bubble, the free end 20A of the movable member 20 is pushed upwards about the fulcrum point (the fixed end 20B), and the movable member 20 assumes a state where the free end 20A is opened widely, due to the elasticity of the movable member 20.

If the movable member 20 assumes an opened state on the nozzle 12 side, then the propagation of the pressure created by the bubble is directed toward the nozzle 12, and furthermore, the direction of growth of the bubble is also guided toward the nozzle 12. Therefore the bubble grows to a great extent on the side of the nozzle 12. On the other hand, when liquid is ejected from the nozzle 12 and the bubble enters an extinction process, then due to the additional effect of the elasticity of the movable member 20, the bubble is caused to extinguish very rapidly and the movable member 20 reverts to its original shape.

In this way, by controlling the direction of propagation of the pressure created by the bubble and the direction of growth of the bubble, by means of the movable member 20, it is possible to improve the ejection characteristics, such as the ejection efficiency, the ejection force, the ejection speed, and the like.

The movable member 20 shown in FIG. 1 is arranged following the direction of flow of the liquid in the liquid chamber 14 (the direction from the common liquid chamber 18 to the nozzle 12), and the length of the movable member 20 (the length in the direction of flow of the liquid in the liquid chamber 14) is determined in such a manner that the free end 20A of the movable member 20 is arranged over the center of the beater 16 (the center of the heater 16 in the left/right direction in FIG. 1). Furthermore, the width of the movable member 20 (the width in the direction perpendicular to the direction of flow of the liquid inside the liquid chamber 14, namely, the direction which passes through the plane of the drawing in FIG. 1) is determined so as to be substantially equal to the width of the heater 16.

Figure 30A:
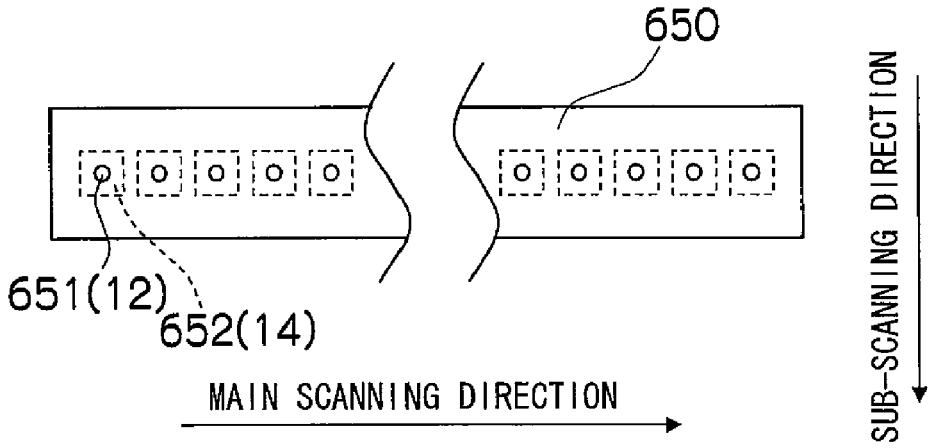
FIGS. 30A and 30B are diagrams illustrating an example of the nozzle arrangement in the head of the inkjet recording apparatus shown in FIG. 27.
Figure 30B:
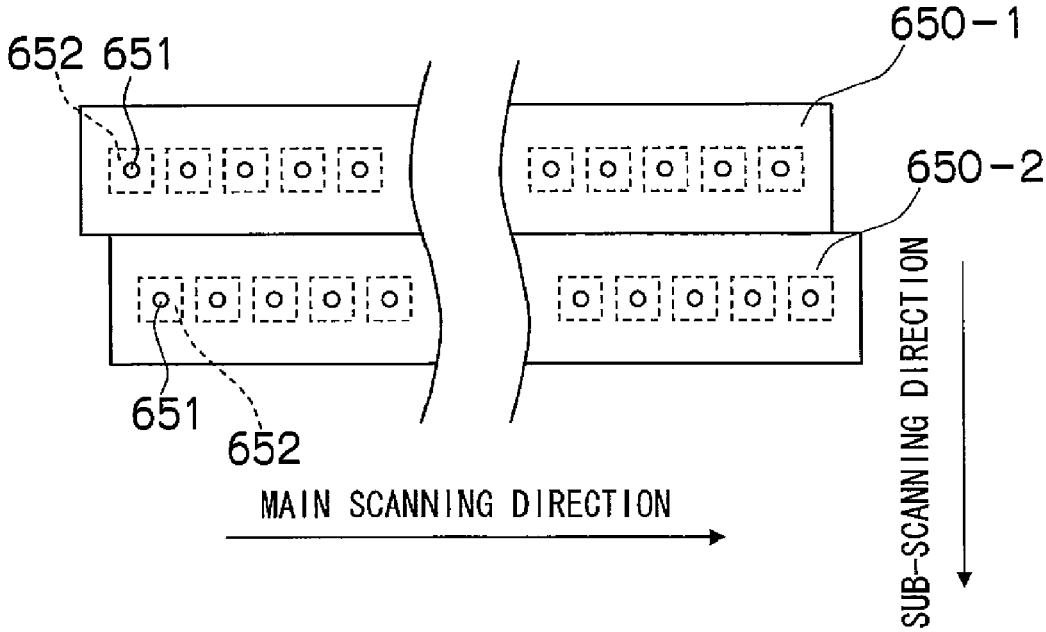

Although FIG. 1 shows just one nozzle 12 and one liquid chamber 14, the head 10 according to the present embodiment has a plurality of nozzles 12 (see FIGS. 30A and 30B). To give an example of the arrangement of the plurality of nozzles 12, there is a possible mode in which the nozzles 12 are arranged in the main scanning direction (the direction passing through the plane of the drawing in FIG. 1). Moreover, it is also possible to adopt a mode in which two or more rows of nozzles are provided in the sub-scanning direction (the vertical direction in FIG. 1).

Furthermore, one movable member 20 may be arranged in each liquid chamber 14. It is also possible to compose the movable member 20 in a comb tooth shape, in such a manner that the fixed end 20B of the movable member 20 and the base portion (fixed member) 22 are shared between a plurality of liquid chambers 14.

Description of Movable Member

Figure 2:
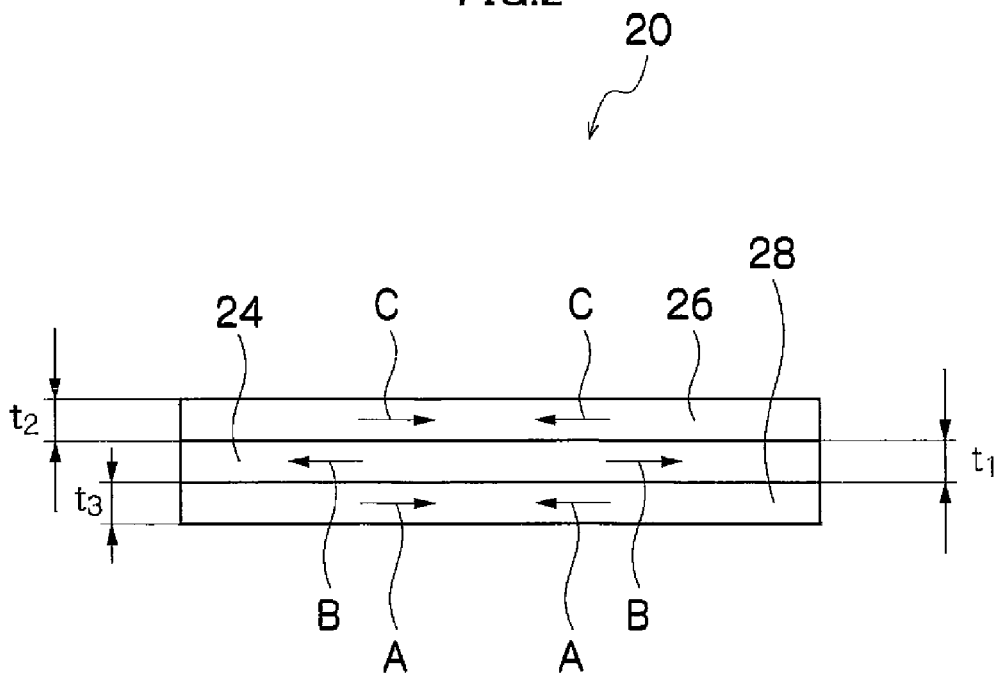
FIG. 2 is an enlarged diagram of the movable member shown in FIG. 1.

Next, the movable member 20 shown in FIG. 1 will be described in detail. The movable member 20 shown in FIG. 1 has a structure in which a first layer 24 is interposed between a second layer 26 and a third layer 28. FIG. 2 is a diagram showing an enlarged view of the movable member 20 shown in FIG. 1.

As shown in FIG. 2, the movable member 20 is formed by stacking a first layer 24 having a tensile stress (the direction of the stress being indicated by reference numeral B in FIG. 2) on a third layer 28 which has compressive stress (the direction of stress being indicated by reference numeral A in FIG. 2), and furthermore stacking a second layer 26 having a compressive stress (the direction of stress being indicated by reference numeral C in FIG. 2) on a surface of the first layer 24 opposite to the surface on which the third layer 28 is arranged.

In the present specification, the terms "tensile stress" and "compressive stress" are defined on the basis of the relative magnitudes of the stress values measured for the first layer 24, the second layer 26 and the third layer 28, independently. For example, if the relationship (stress of first layer 24)>(stress of second layer 26) is satisfied, then the stress of the first layer 24 is taken to be a "tensile stress" and the first layer 24 is taken to be a "tensile stress layer (a layer having a tensile stress)". On the other hand, the stress of the second layer 26 is taken to be a "compressive stress", and the second layer 26 is taken to be a "compressive stress layer (a layer having a compressive stress)". Moreover, the compressive stress is a stress in the negative direction and the tensile stress is a stress in the positive direction.

More specifically, the movable member 20 has a structure in which the second layer 26 that serves as a surface layer is stacked on the upper surface of the first layer 24 that is an internal layer (core layer) and the third layer 28 that serves as another surface layer is stacked on the lower surface of the first layer 24. Moreover, the first layer 24, the second layer 26 and the third layer 28 have a relationship of: (stress of first layer 24)>(stress of second layer 26); and (stress of first layer 24)>(stress of third layer 28).

As shown in FIGS. 1 and 2, by imparting a compressive stress to the surface layers (i.e., the second layer 26 and the third layer 28) of the movable member 20 and imparting a stress differential between the internal layer (i.e., the first layer 24) and the surface layers, then even if cracks appear in the second layer 26 which forms a surface layer, for example, those cracks will never progress and extend into the internal layer (first layer 24), and therefore breaking of the movable member 20 is prevented.

For the material of the movable member 20, it is appropriate to use a material, such as SiC, SiN, Ni, Ta, W, or the like, which can be formed as a film by plating, sputtering, CVD, or another thin film formation process. For example, it is desirable that Ni is used for the first layer 24 and Ta is used for the second layer 26 and third layer 28, since the adhesion between the layers is good and furthermore, the Ta has excellent resistance to ink.

The fixing member 22 which fixes the movable member 20 to the substrate 15 is formed by a thin film formation process, such as plating, sputtering, CVD, or the like, similarly to the movable member 20, and therefore a material such as SiC, SiN, Ni, Ta or W can be used for same A desirable mode is one where the material used for the fixing member 22 is the same as that used for the third layer 28 (the layer which is bonded to the fixing member 22).

In the movable member 20 shown in FIG. 2, the thickness $t_1$ of the first layer 24, the thickness $t_2$ of the second layer 26 and the thickness $t_3$ of the third layer 28 are determined in accordance with the level of stress (stress differential) that is to be set between the respective layers. In other words, it is possible to impart the required stress differential between the respective layers by altering the thickness of each layer, accordingly.

If the overall thickness of the movable member 20 is too thin, then the stress differential between the internal layer and the surface layers will be too small and the movable member 20 is liable to break, and moreover, the overall strength (rigidity) of the movable member 20 is reduced. Therefore, from the viewpoint of the strength of the movable member 20, a desirable mode is one where the overall thickness of the movable member 20 is 1 μm or greater (namely, $t1+t2+t3 \geqq 1$ μm).

The other dimensions of the movable member 20 depend on the size of the liquid chamber 14 and the size of the heater 16. To give one example, if the size of the heater 16 is set to 20 μm×20 μm, then the liquid chamber 14 may have a width of 30 μm (the length in the direction perpendicular to the plane of the drawing in FIG. 2 (the direction perpendicular to the direction of the flow of liquid)), a length of 100 μm (the length in the left/right direction in FIG. 2 (the direction of the flow of liquid)), and a height of 30 μm, and the movable member 20 may have a total thickness (i.e., the total thickness of all the three layers) of 1 μm to 20 μm, a width of 5 μm to 30 μm (the length in the direction perpendicular of the plane of the drawing in FIG. 2 (the direction perpendicular to the direction of the flow of liquid)), and a length of 50 μm to 500 μm (the length in the left/right direction in FIG. 2 (the direction of the flow of liquid)). In a mode where a piezoelectric element is used as a pressurization device, if the piezoelectric element is 200 μm×200 μm, then the liquid chamber 14 may have a width of 250 μm, a length of 300 μm and a height of 50 μm.

FIG. 3 is a diagram showing the results of an evaluative experiment to confirm whether or not the movable member 20 breaks when the differential between the stress of the first layer 24 (tensile stress) and the stress of the second layer 26 (=stress of the third layer 28, compressive stress), namely, the stress differential (MPa) between the films, is altered. In this evaluative experiment, the movable member 20 was subjected to the deformation 1,000,000 times by repeating an ejection operation 1,000,000 times continuously at a prescribed ejection frequency, whereupon the movable member 20 was checked to see whether or not cracks had appeared in the first layer 24, and whether or not detachment had occurred between the layers.

If the differential between the stress of the first layer 24 and the stress of the second layer 26 and the third layer 28 is too small, then the effect in preventing the advance of cracks is reduced. On the other hand, if the differential between the stress of the first layer 24 and the stress of the second layer 26 and the third layer 28 is too large, then detachment between the layers occurs, and there is a concern that the movable member 20 may break apart.

As shown in FIG. 3, in a case where the stress differential between the films (layers) was 10 MPa, then it was not possible to obtain an effect of preventing the occurrence of cracks in the first layer 24, and preventing the advance of these cracks leading to the breakdown of the movable member 20. Moreover, in a case where the stress differential between the films was 1000 MPa, then detachment between the films occurred and the movable member 20 broke down.

On the other hand, it was confirmed that if the stress differential between the films is not less than 50 MPa and not greater than 500 MPa, then even if cracks have appeared in the second layer 26 and the third layer 28, it was possible to obtain an effect in preventing the cracks from advancing so as to create cracks in the first layer 24, and detachment between the films could also be avoided.

In other words, if the stress differential between the first layer 24 and the second layer 26, and the stress differential between the first layer 24 and the third layer 28 are set to be equal to or greater than 50 MPa and equal to or less than 500 MPa, then breaking of the movable member 20 is prevented.

As stated previously, it is desirable to use a thin film formation process, such as plating, sputtering, or CVD, for forming the first layer 24, the second layer 26 and the third layer 28 which constitute the movable member 20. By changing the conditions (the film formation conditions) of the processes for the respective films to be formed by these techniques, it is possible to control the stresses of the respective films.

For example, in a plating technique, the type of bath (plating solution) can be changed. FIG. 4 is a diagram showing a comparison between the physical and mechanical characteristics under the same electrolysis conditions (temperature: 55° C., current density: 5.0 A/dm$^2$), according to a plurality of types of the nickel electroplating bath. FIG. 4 cites Table 3-9 on page 73 of "*Denchû gijutsu to ôyô*" ("Electroforming technology and its Applications"), (Hideo Ise, Makishoten).

The electrodeposition stress (also referred to as "stress in electrodeposits") for the nickel electrodeposition shown in FIG. 4 is generally a tensile stress. In FIG. 4, a tensile stress is indicated as a positive stress, and a negative stress means a compressive stress. As shown in FIG. 4, by altering the type of nickel electroforming bath) it is possible to vary the electrodeposition stress (film stress) between 29.5 (kg/mm$^2$) and −3.5 (kg/mm$^2$).

Figure 5A:
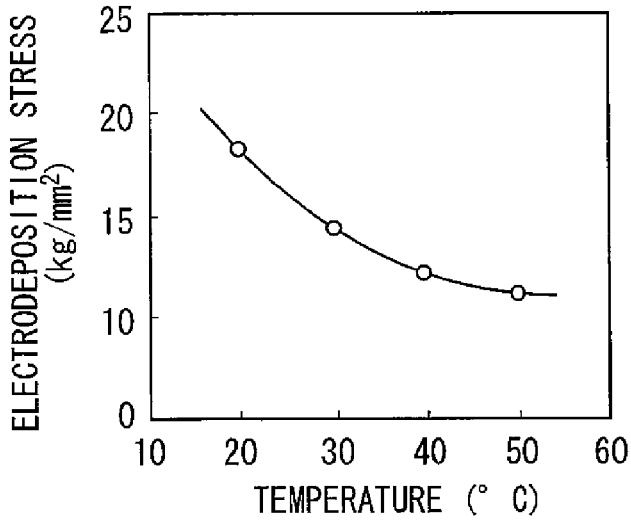
FIGS. 5A to 5C are diagrams describing the relationship between plating conditions (i.e., temperature, pH and current density) and the electrodeposition stress.
Figure 5B:
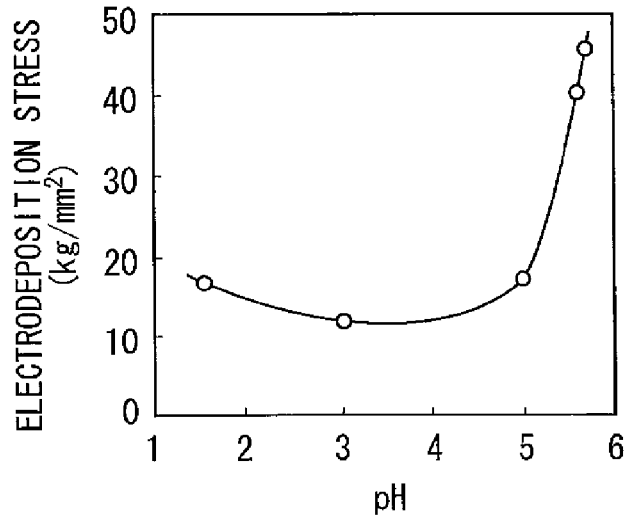
Figure 5C:
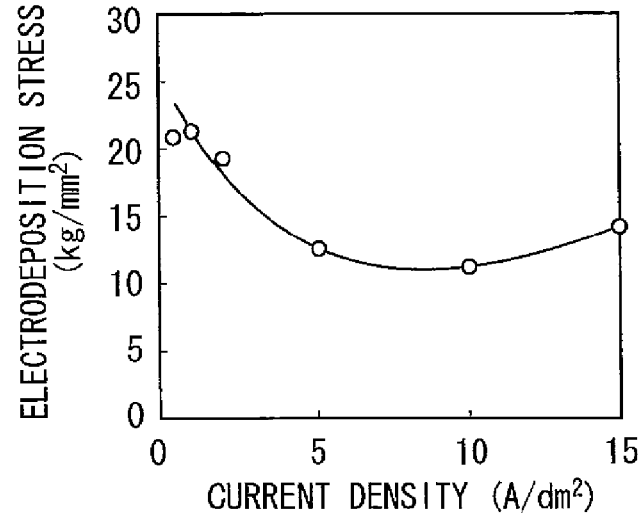

FIG. 5A is a diagram showing the relationship between temperature and electrodeposition stress (under conditions of a Watts bath, pH 3, and current density 5 A/dm$^2$), FIG. 5B is a diagram showing the relationship between the pH and the electrodeposition stress (under conditions of temperature 50° C. to 55° C. and current density 4 A/dm$^2$ to 5 A/dm$^2$), and FIG. 5C is a diagram showing the relationship between the current density and the electrodeposition stress (under conditions of pH 3 to 4 and temperature 50° C. to 55° C.).

Figure 6A:
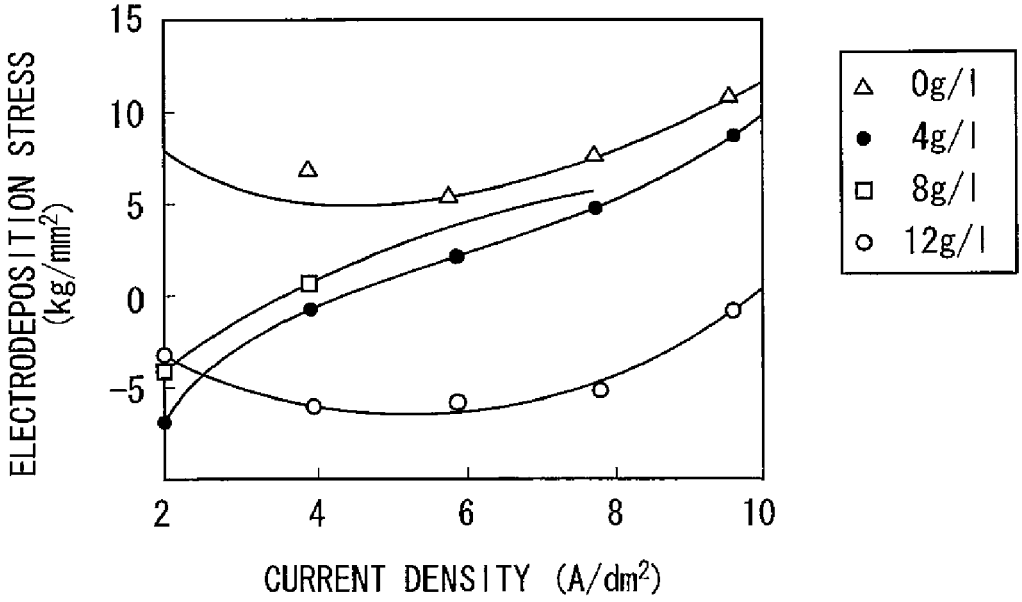
FIGS. 6A and 6B are diagrams describing the effects of a pressure reducing agent.
Figure 6B:
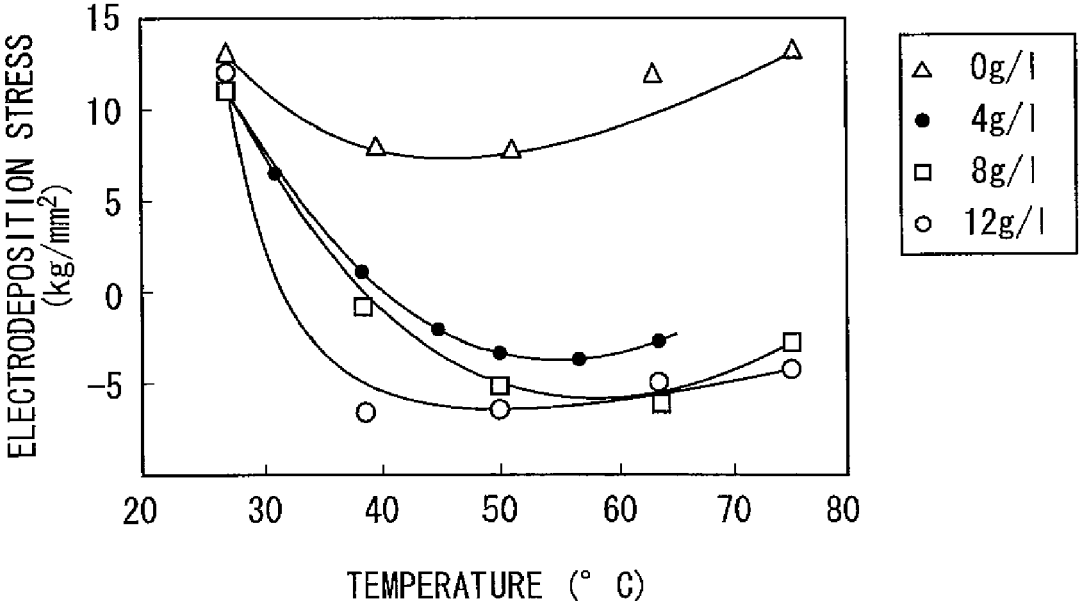

Moreover, FIG. 6A is a diagram showing the relationship between the current density and the electrodeposition stress when the added amount of stress reducing agent is varied (i.e., the added amount is selected from 0 g/l, 4 g/l, 8 g/l and 12 g/l) while the temperature is kept at 40° C. Furthermore, FIG. 6B is a diagram showing the relationship between the temperature and the electrode position stress when the added amount of pressure reducing agent is varied (i.e., the added amount is selected from 0 g/l, 4 g/l, 8 g/l and 12 g/l) while the current density is kept at 4 A/dm$^2$.

FIGS. 5A to 5C and FIGS. 6A and 6B cite Table 3-21, Table 3-22, Table 3-23 and Table 3-28 on page 79, page 80, and page 84 of "*Denchû gijutsu to ôyô*" ("Electroforming and its Applications"), (Hideo Ise, Makishoten).

In other words, as shown in FIGS. 5A to 5C, the electrodeposition stress can be changed by altering any of the following parameters: temperature (° C.), pH, and current density (A/dm$^2$). Furthermore, as shown in FIGS. 6A and 6B, the electrodeposition stress also changes due to the effects of the stress reducing agent (sulfamine acid, nickel chloride bath).

Figure 7:
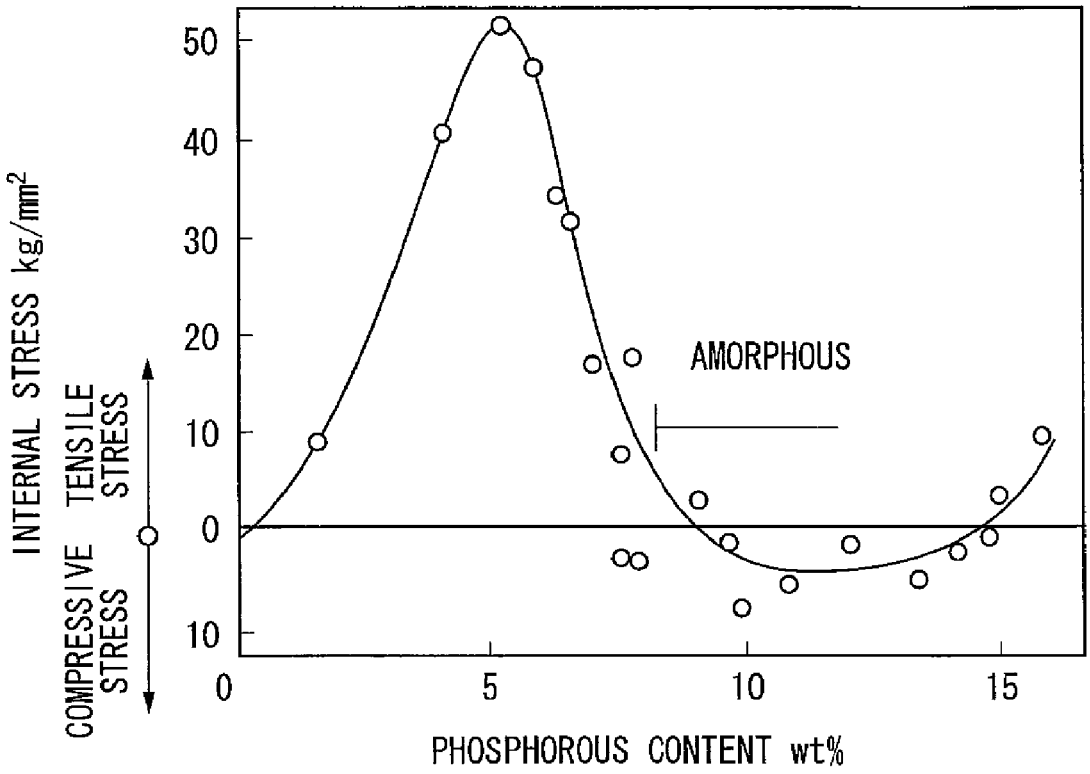
FIG. 7 is a diagram describing the relationship between the stress and the added amount of additive.

FIG. 7 is a diagram showing the relationship between the phosphorous content and the internal stress, in the case of electroless nickel-phosphorous plating. As shown in FIG. 7, it can be seen that the internal stress changes as the content of phosphorous changes. FIG. 7 cites from page 36 of "*Mudenkai mekki Kisoku to ôyô*" ("Electroless plating: Fundamentals and Applications") (Japan Society of Electro-plating, ed., The Nikkan Kogyo Shimbun Ltd.).

In other words, if the movable member is manufactured by using a plating method, then it is possible to make the stress of the first layer 24 different than that of the second layer 26, or to make the stress of the first layer 24 different than that of the third layer 28, by altering the conditions such as the composition of the plating solution (type of plating bath), the temperature, pH, current density, composition of additives, and the like.

Furthermore, if the movable member 20 is manufactured by using sputtering or CVD, then it is possible to control the stress of the film by controlling the pressure of the gas in the process atmosphere, or the power.

The technology for controlling the stress of the film formed by sputtering or CVD is described on page 126 of the reference document "2003 Micromachining/MEMS technology, complete manual" (separate publication of Electronic Journal), and on page 34 of the reference document "*MEMS no hanashi*" ("About MEMS") (The Nikkan Kogyo Shimbun Ltd.).

To summarize the foregoing, in order to make the stress of the first layer 24 of the movable member 20 different than those of the second layer 26 and the third layer 28, it is possible to make the material of the first layer 24 different from those of the second layer 26 and the third layer 28. Alternatively, it is also possible to change the film forming conditions between the first layer 24 and the second layer 26 and to change the film forming conditions between the first layer 24 and the third layer 28 while using the same material for the first layer 24, second layer 26 and third layer 28.

For example, by using the same material for the first layer 24, the second layer 26 and the third layer 28, and making the second layer 26 and the third layer 28 thicker than the first to layer 24, it is possible to make the stress of the second layer 26 and the third layer 28 lower than the stress of the first layer 24, and therefore a stress differential can be imparted between the first layer 24 and the second layer 26, and between the first layer 24 and the third layer 28.

If the stress is different between the second layer 26 and the third layer 28, then the whole movable member 20 bends toward the layer having the greater stress, and therefore a desirable mode is one where the stress of the second layer 26 is equal to the stress of the third layer 28.

According to the liquid ejection head 10 having the composition described above, the movable member 20 which is arranged in the liquid chamber 14 in order to enhance the ejection efficiency is formed with a three-layer laminated structure, in which the second layer 26 having a lower stress than the first layer 24 forming an internal layer is formed on one surface of the first layer 24, and the third layer 28 having a lower stress than the first layer 24 is formed on the other surface of the first layer 24, thereby interposing the first layer 24 forming the internal layer between the second layer 26 and the third layer 28 which are two surface layers having compressive stress. By means of this composition, even if cracks appear in the second layer 26 or the third layer 28, these cracks are prevented from advancing into the first layer 24, and hence breaking of the movable member 20 is prevented.

Description of Process for Manufacturing Movable Member

Next, a process for manufacturing the movable member 20 described above will be explained. FIGS. 8A to 8H are schematic drawings of respective steps in a case where the movable member 20 is manufactured by a plating method.

Figure 8A:
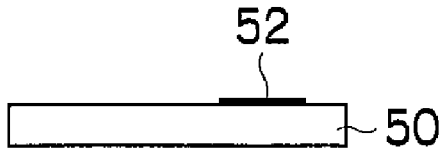
FIGS. 8A to 8H are step diagrams of the manufacture of the head (movable member) shown in FIG. 1.

As shown in FIG. 8A, a first plating electrode 52 is formed on a region of the substrate 50 (the substrate forming the base plate 15 of the liquid chamber 14 in FIG. 1) where the fixing member 22 (see FIG. 1) is to be formed (first plating electrode forming step). Although the heater (see FIG. 1) or the process for forming the heater is not shown in FIGS. 8A to 8H, it is supposed that a heater has already been formed on the substrate 50 shown in FIG. 8A.

Figure 8B:
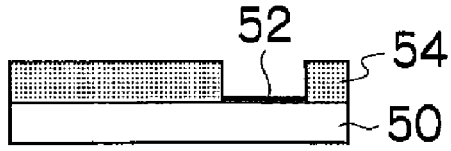

Thereupon, a first resist layer 54 which is to serve as a mask pattern for the fixing member is formed (first resist layer forming step). As shown in FIG. 8B, the first resist layer 54 having the same thickness as the height of the fixing member is formed on the first plating electrode non-forming region, which is the area apart from the region where the electrode 52 has been formed.

Figure 8C:
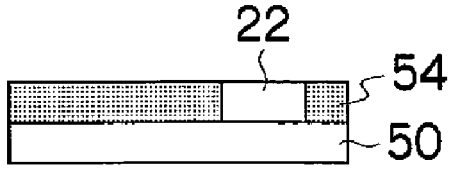

Thereupon, as shown in FIG. 8C, the fixing member 22 is formed on the region where the first plating electrode 52 is formed, using electroforming (plating) (fixing member forming step).

Figure 8D:
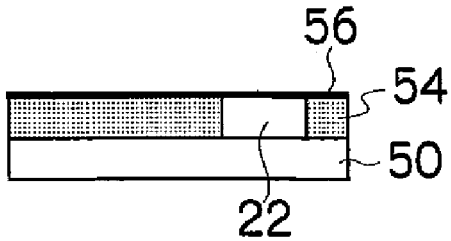

When the fixing member 22 has been formed at a prescribed position on the substrate 50 by electroforming, a second plating electrode 56 is formed over the whole of the surfaces of the first resist layer 54 and the fixing member 22, on the opposite side to the substrate 50, as shown in FIG. 8D (second plating electrode forming step).

Figure 8E:
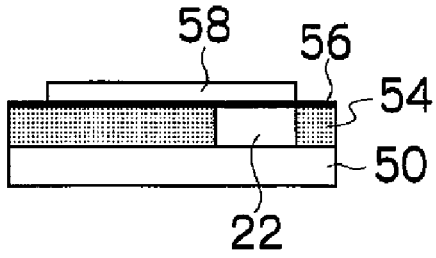
Figure 8F:
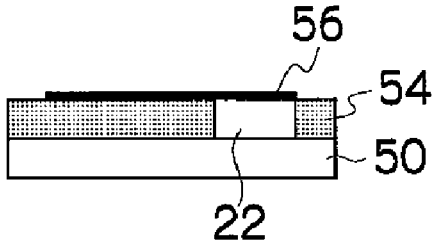

Thereupon, as shown in FIG. 8E, a second resist layer 58 which is to serve as a mask pattern for patterning the second plating electrode 56 is formed. In other words, a second resist layer 58 having a pattern which corresponds to the region where the movable member 20 is to be created, is formed (second resist layer forming step).

When the patterned second resist layer 58 has been formed, the portion of the second plating electrode 56 which is not covered by the second resist layer 58 is removed by etching, or another such technique, and the second resist layer 58 is then removed, and patterning is provided to the second plating electrode 56 (second plating electrode patterning step). If a film formation method which is capable of directly patterning the second plating electrode 56 is employed (in other words, an aerosol deposition method (also referred to as "AD method", simply), direct printing by an inkjet recording apparatus, or the like), then it is possible to combine the processing from the second plating electrode forming step to the second plating electrode patterning step into a single step.

Figure 8G:
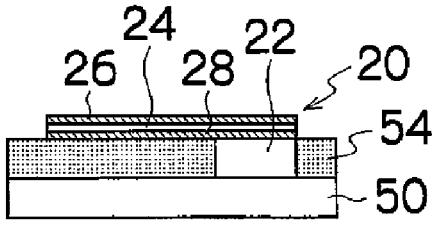
Figure 8H:
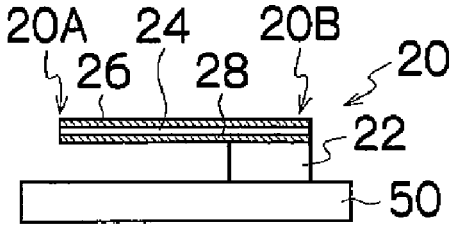

When the second plating electrode 56 has been patterned in accordance with the position at which the movable member 20 is to be formed, then as shown in FIG. 8G, the three layers constituting the movable member 20 are deposited sequentially in order of the third layer 28, the first layer 24, and second layer 26 by electroforming (movable member forming step).

Next, the first resist layer 54 is removed by etching, or another such technique as shown in FIG. 80 (first resist removal step). By this means, the movable member 20 is created on the substrate 50, one end 20A of the movable member 20 forming a free end and the other end 20B thereof being fixed to the fixing member 22.

FIGS. 9A to 9L are schematic drawings showing respective steps for manufacturing a movable member 20 using a sputtering technique (or by CVD). Although the heater and the process for forming the heater are not shown in FIGS. 9A to 9L, it is supposed that a heater has been formed already on the substrate 50 shown in FIG. 9A.

Figure 9A:
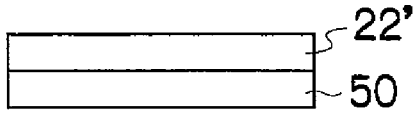
FIGS. 9A to 9L are step diagrams of another manufacture process that is different from the manufacture process shown in FIGS. 8A to 8H.

Firstly, as shown in FIG. 9A, a layer 22' which is to serve as a fixing member is deposited onto the substrate 50, using a sputtering method (or CVD) (fixing member layer film deposition step).

Figure 9B:
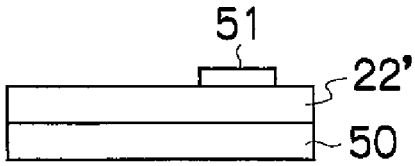
Figure 9C:
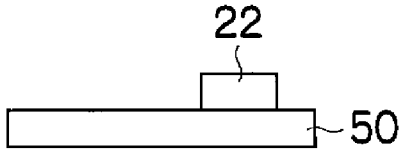

Thereupon, as shown in FIG. 9B, a resist layer 51 which is to serve as a mask is formed on the fixing member forming region of the layer 22', on the opposite side to the substrate 50, and as shown in FIG. 9C, a fixing member 22 is then formed by patterning the layer 22' (fixing member layer patterning step).

Figure 9D:
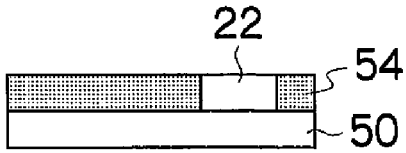
Figure 9E:
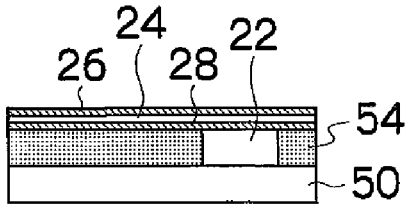

Thereupon, as shown in FIG. 9D, a first resist layer 54 is formed on the surface of the substrate 50 on which the fixing member 22 is formed. The height of the first resist layer 54 is the same as the height of the fixing member 22, and therefore a flat surface is formed by the surface of the first resist layer 54 on the side opposite to the substrate 50 and the surface of the fixing member 22 on the side opposite to the substrate 50 (first resist layer forming step).

When the first resist layer 54 has been formed, three layers constituting the movable member 20 are deposited by a sputtering method (or by CVD), in the order, third layer 28, first layer 24, second layer 26, over the whole of the flat surface described above, as shown in FIG. 9E (movable member film deposition step).

Figure 9F:
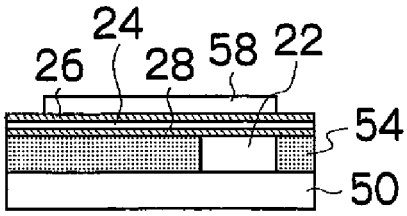

Next, as shown in FIG. 9F, a second resist layer 58 for patterning the three layers constituting the movable member 20 is formed (second resist layer forming step).

Figure 9G:
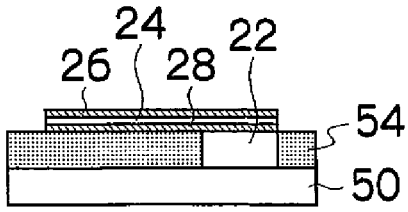
Figure 9H:
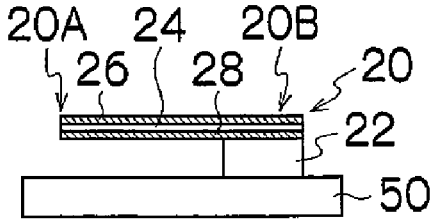

Thereupon, as shown in FIG. 9G, the portions of the first layer 24, second layer 26 and third layer 28 which are not covered by the second resist layer 58 are removed by etching, or another such technique (movable member patterning step). Next, as shown in FIG. 9H, the first resist layer 54 is then removed (first resist layer removal step), thereby forming, on the substrate 50, a movable member 20 of which one end 20A forms a free end and the other end 20B is fixed to the fixing member 22.

Figure 9I:
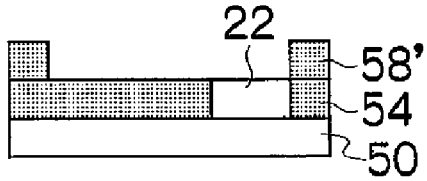
Figure 9J:
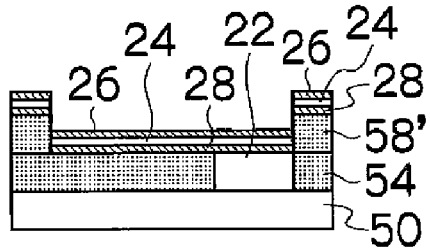
Figure 9K:
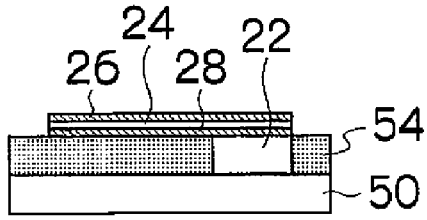
Figure 9L:
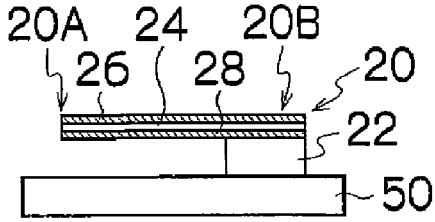

Instead of the steps shown in FIGS. 9E to 9H, it is also possible to use a liftoff technique which includes the steps shown in FIGS. 9I to 9L. After forming a flat surface of the first resist layer 54 and the fixing member 22, by means of a second resist layer forming step which is illustrated in FIG. 9D, a resist layer 58' having an inverse pattern to that shown in FIG. 9F is formed, as shown in FIG. 9I (inverse pattern resist layer forming step), the three layers constituting the movable member 20 are deposited by sputtering (or CVD) in the order third layer 28, first layer 24, second layer 26, over the whole of the aforementioned flat surface (the movable member film forming step shown in FIG. 9J), the unwanted portions of the first layer 24, second layer 26, third layer 28 and resist layer 58' are removed (movable member patterning step shown in FIG. 9K), and the first resist layer 54 is then removed as shown in FIG. 9L (first resist layer removal step), thereby forming, on the substrate 50, a movable member 20 of which one end 20A forms a free end and the other end 20B is fixed to the fixing member 22.

Figure 10A:
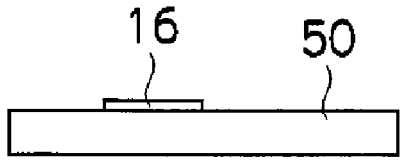
FIGS. 10A to 10H are step diagrams of the manufacture of a head according to an embodiment of the present invention.
Figure 10B:
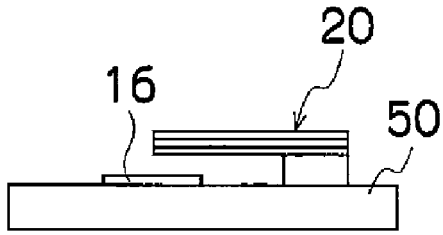
Figure 10C:
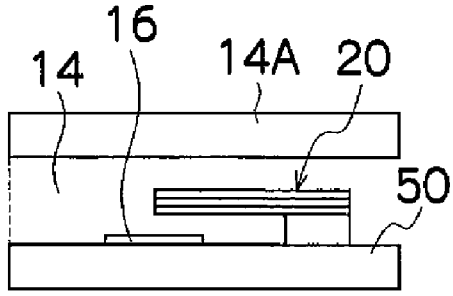
Figure 10D:
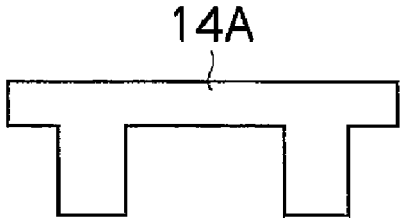

FIGS. 8A to 8H and FIGS. 9A to 9L focus in particular on the steps required to manufacture a movable member, of the process for manufacturing a head according to the present embodiment. Other steps for manufacturing the head include a heater manufacturing step for forming a heater 16 on the substrate 50 (FIG. 10A), a movable member forming step of forming the movable member 20 at a prescribed position of the substrate 50 where the heater 16 has been formed (FIG. 10B), and a flow channel member bonding step of bonding a separately manufactured flow channel member 14A to the substrate 50 (FIG. 10C). FIG. 10D shows a diagram of a flow channel member 14A as viewed from the left-hand side in FIG. 1C.

Figure 10E:
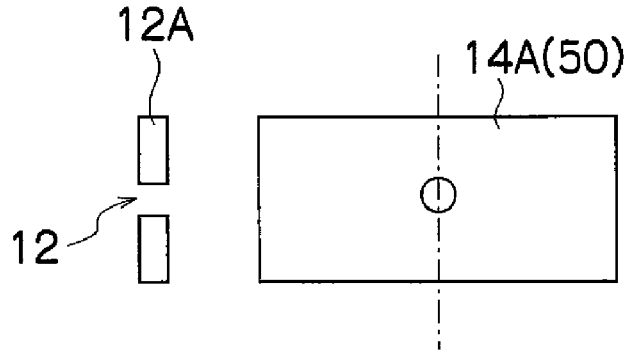
Figure 10F:
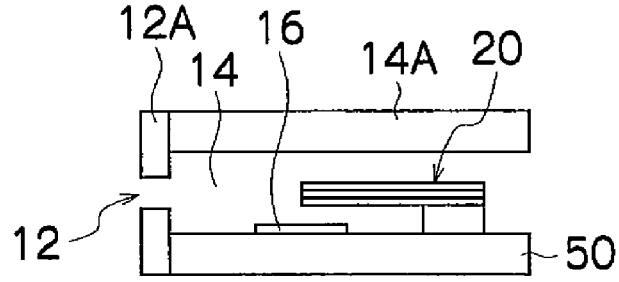
Figure 10G:
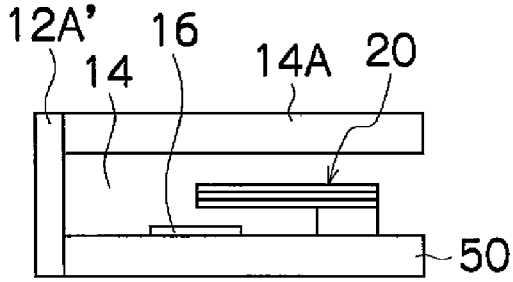
Figure 10H:
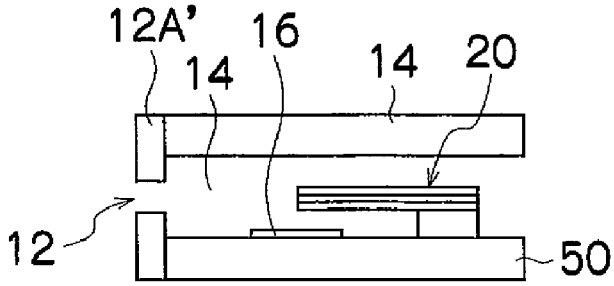

When the flow channel member 14A has been bonded to the substrate 50, a nozzle plate 12A is then bonded (nozzle plate bonding step). FIG. 10E is a diagram showing a substrate 50 to which a nozzle plate 12A and a flow channel plate 14A are bonded, as viewed from above (a state prior to bonding the nozzle plate 12A), and FIG. 10F is a cross-sectional diagram of the bonded state of the nozzle plate 12A, as viewed from the side. As shown in FIGS. 10G and 10H, it is also possible to bond a nozzle plate 12A' which does not yet contain orifices to serve as nozzles 12, onto the substrate 50 to which the flow channel member 14A has been bonded (nozzle plate bonding step, FIG. 10G), and to then form orifices serving as nozzles 12 subsequently (hole forming step, FIG. 10H). After also carrying out a cleaning step (not illustrated) and an inspection step, and the like, the head is then completed.

FIRST MODIFICATION EXAMPLE

Next, a first modification example of the present embodiment will be described. FIGS. 11A to 11G are diagram showing a schematic view of the respective steps of a method of manufacturing a movable member 120 which is bonded directly to a substrate 50, the fixing member 22 (see FIG. 1) for supporting the fixed end 120A of the movable member 120 being omitted from the composition. Similarly to FIGS. 8A to 8H and FIGS. 9A to 9L, steps other than those involved in manufacturing a substrate including a movable member are not shown and are omitted from the description.

Figure 11A:
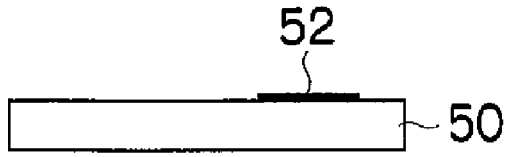
FIGS. 11A to 11H are step diagrams of the manufacture of a head according to a first modification example of the present embodiment.
Figure 11B:
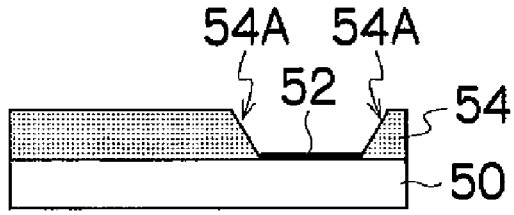
Figure 11C:
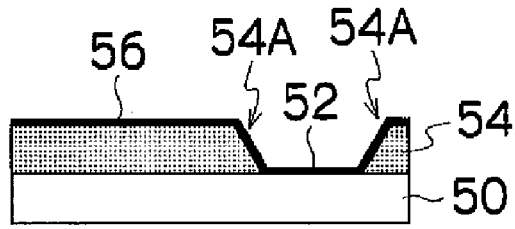
Figure 11D:
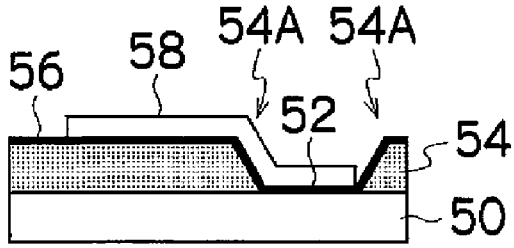
Figure 11E:
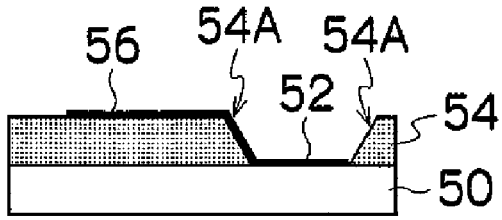
Figure 11F:
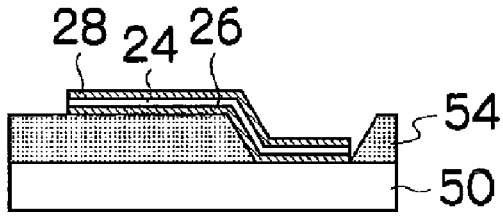
Figure 11G:
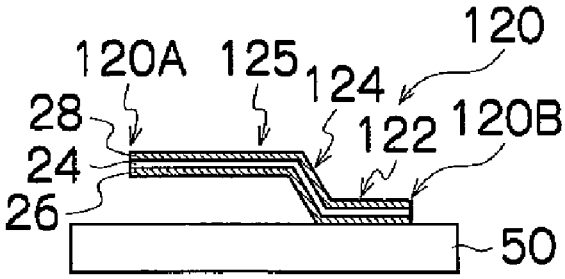

The movable member 120 shown in FIG. 11G comprises: a fixed section 122 including a fixed end 120B which is fixed to a substrate 50; a raised section 124 having a shape which rises obliquely from the fixed section 122 in the direction of the nozzle (see FIG. 1); and a movable section 126 including a free end 120A which is arranged at a prescribed distance from the substrate 50.

FIGS. 11A to 11G show a schematic view of the steps for manufacturing a movable member 120 having a structure which does not incorporate a fixing member 22, using a plating method.

Firstly, as shown in FIG. 11A, a first plating electrode 52 is formed on the substrate 50 (first plating electrode forming step). The region where the first plating electrode 52 is formed becomes the region (the region corresponding to the fixed section 122) where the movable member 120 is fixed to the substrate 50.

Thereupon, as shown in FIG. 11B, a first resist layer 54 is formed in the first plating electrode non-forming region, where the first plating electrode 52 has not been formed. An inclined section 54A is provided in the first resist layer 54, being formed to correspond to the shape (gradient) of the raised section 124 of the movable member 120, in such a manner that the opening is larger on the side opposite to the side of the first plating electrode 52 (namely, on the upper side in FIG. 11B) (first resist layer forming step).

Thereupon, as shown in FIG. 11C, a second plating electrode 56 is formed over the whole surface of the resist layer 54 on the side opposite to the substrate 50, and the inclined section 54A (second plating electrode forming step). The second plating electrode 56 is formed in such a manner that it becomes bonded to the first plating electrode 52 and an electrical connection is established between the first plating electrode 52 and the second plating electrode 56.

When the first plating electrode 52 and the second plating electrode 56 have been formed, then as shown in FIG. 11D, a second resist layer 58 having a pattern corresponding to the shape of the movable member 120 is formed on the first plating electrode 52 and the second plating electrode 56 (second resist layer forming step), whereupon, as shown in FIG. 11E, the portions of the second plating electrode 56 which are not covered by the second resist layer 58 are removed, and the second resist layer 58 is then removed, thereby patterning the second plating electrode 58 so as to correspond to the shape of the movable member 120 (second plating electrode patterning step).

Thereupon, as shown in FIG. 11F, three layers constituting the movable member 120 are formed in the order: third layer 28, first layer 24, second layer 26, using the first plating electrode 52 and the patterned second plating electrode 56 as plating electrodes (movable member film formation step), and the first resist layer 54 is removed, thereby yielding a movable member 120 having a stricture which does not include a fixing member 22 (See FIG. 1).

Figure 11H:
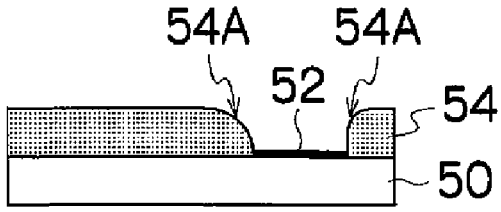

When the first resist layer 54 has been formed in FIG. 11B, the inclined section 54A of the first resist layer 54 may be heated in order to impart a curved shape to the inclined section 54A, as shown in FIG. 11H. By this means, the transitional portion between the raised section 124 and the movable part 125 of the movable member 120 shown in FIG. 11G will have a curved shape, thereby alleviating the concentration of stress in this transition portion when the movable member 120 is operated and thus contributing to preventing the breaking of the movable member 120.

FIGS. 12A to 12E are diagrams showing a schematic view of steps for manufacturing a movable member 120 by sputtering (or CVD).

Figure 12A:
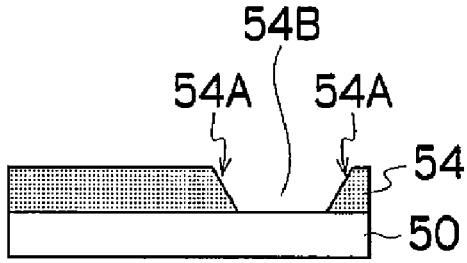
FIGS. 12A to 12E are step diagrams of another manufacture process that is different from the manufacture process shown in FIGS. 11A to 11H.

Firstly, as shown in FIG. 12A, a first resist layer 54 is formed on the substrate 50 (first resist layer forming step). An inclined section 54A and an open section 54B are provided in the first resist layer 54 so as to correspond to the shape of the movable member 120. In the open section 54B, the substrate 50 is exposed to the exterior and this exposed portion of the substrate 50 is the portion where the movable member 120 is fixed.

Figure 12B:
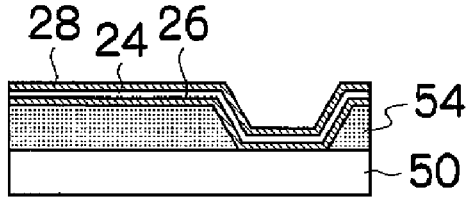
Figure 12C:
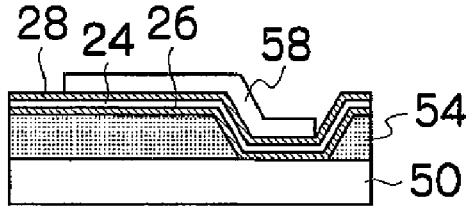

When the first resist layer 54 has been formed, then as shown in FIG. 12B, three layers constituting the movable member 120 are formed in the order, third layer 28, first layer 24, second layer 26, over the exposed portion of the substrate 50 and the whole surface of the first resist layer 54 (movable member film formation step). Thereupon, as shown in FIG. 12C, a second resist layer 58 which has been patterned in accordance with the shape of the movable member 120 is formed (second resist layer forming step).

Figure 12D:
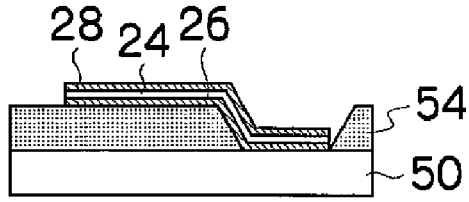
Figure 12E:
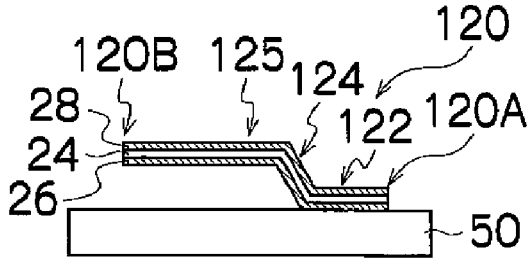

When the second resist layer 58 patterned in accordance with the shape of the movable member 120 has been formed, then as shown in FIG. 12D, the portions of the first layer 24, second layer 26 and third layer 28 which are not covered by the second resist layer 58 are removed (movable member patterning step), and the second resist layer 58 is then removed (second resist layer removal step). Whereupon, the first resist layer 54 is removed as shown in FIG. 12E (first resist layer removal step), thus manufacturing a movable member 120 having a structure which does not include a fixing member 22.

According to the first modification example which was described above, the structure of the head 10 is simplified in comparison with a mode where the movable member 20 is fixed to a substrate (the bottom surface of the liquid chamber 14) by means of a fixing member 22. Furthermore, by omitting the fixing member 22, then problems such as detachment in the bonding section between the movable member and the fixing member due to stress during deformation of the movable member are avoided, and increase in the long-term reliability of the whole head 10 can be expected.

SECOND MODIFICATION EXAMPLE

Figure 13:
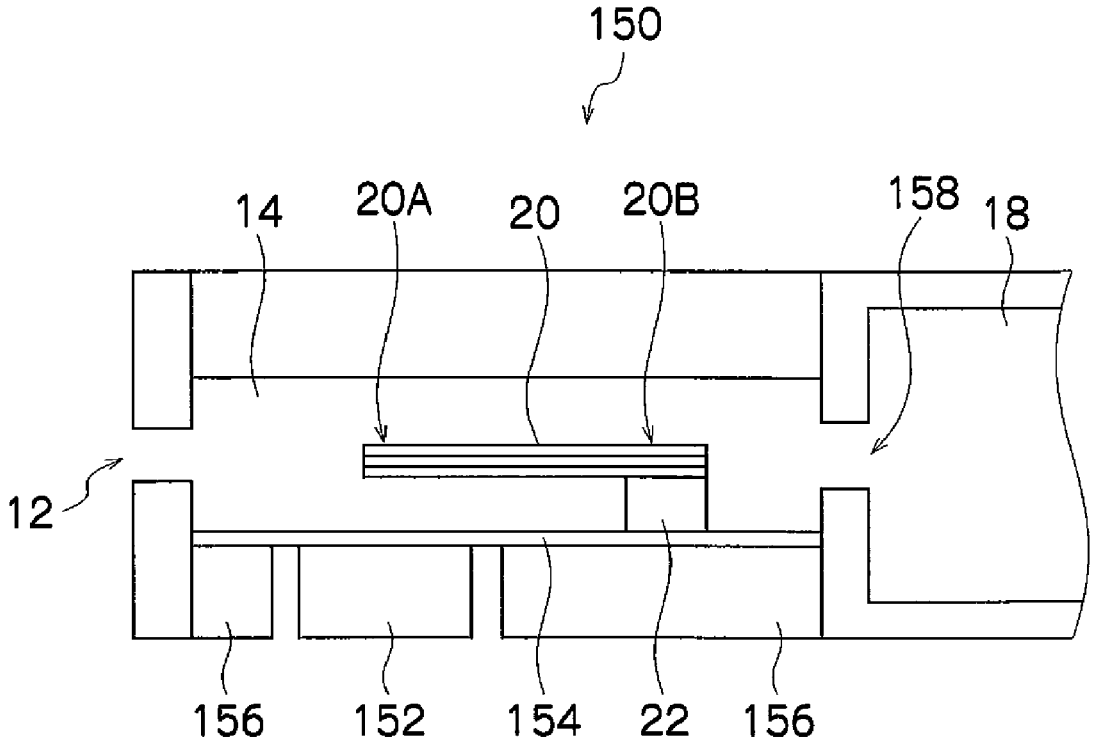
FIG. 13 is a cross-sectional diagram showing the structure of a head according to a second modification example of the present embodiment.

Next, a second modification example of the present embodiment will be described. FIG. 13 is a cross-sectional diagram showing the structure of a head 150 according to a second modification example. In FIG. 13, parts which are the same as or similar to FIG. 1 are labeled with the same reference numerals and further explanation thereof is omitted here.

The head 150 shown in FIG. 13 comprises a piezoelectric element 152 which serves as an ejection energy generation device (pressurization device), instead of the heater 16 of the head 10 in FIG. 1.

In other words, in this head 150, the fixed end 20B of a movable member 20 is bonded via a fixing member 22 to a diaphragm 154 which forms the bottom surface of the liquid chamber 14, on the surface corresponding to the inner side of the liquid chamber 14, and a piezoelectric element 152 is bonded to the diaphragm 154 on the surface corresponding to the outside of the liquid chamber 14, at a position corresponding to the free end 20A of the movable member 20 of the diaphragm 154 and the vicinity thereof. A base substrate 156 which supports the diaphragm 154 is provided on the surface of the diaphragm 154 corresponding to the outer side of the liquid chamber 14, in the region where the piezoelectric element 152 is not arranged.

Furthermore, a supply port 158 which functions as a supply restrictor is formed on the wall of the liquid chamber 14 so as to face the nozzle 12, and the liquid chamber 14 is connected via this support port 158 to the common liquid chamber 18.

In the head 150 shown in FIG. 13, if the piezoelectric element 152 is operated by applying a prescribed drive signal to the piezoelectric element 152, then the portion of the diaphragm 154 where the piezoelectric element 152 is arranged will deform toward the inner side of the liquid chamber 14, thereby applying pressure to the liquid inside the liquid chamber 14. Furthermore, the free end 20A is pushed upwards about the fulcrum of the fixed end 20B of the movable member 20 due to the pressurization by the piezoelectric element 152, and the movable member 20 assumes a shape in which the free end 20A is opened wide.

When the movable member 20 has assumed an opened shape toward the nozzle 12, the propagation of the pressure applied by the piezoelectric element 152 is directed toward the nozzle 12, and furthermore, the cross-sectional area of the liquid flow path in the liquid chamber 14 is reduced on the side of the supply port 158 in comparison with a state where the movable member 20 is not deformed. Consequently, the liquid in the liquid chamber 14 becomes more liable to flow toward the nozzle 12, and less liable to flow toward the supply port 158, and therefore the ejection efficiency is improved.

On the other hand, when liquid is ejected from the nozzle 12 and a refill phase is started by operating the piezoelectric element 152 in a direction which expands the volume of the liquid chamber, then the movable member 20 reverts to its original state due to the elastic force of the movable member 20. Consequently, the liquid flows readily into the liquid chamber 14 from the supply port 158, and the refill efficiency is improved.

In this way, by controlling the direction of propagation of the applied pressure and the direction of flow of the liquid in the liquid chamber 14 by means of the movable member 20, it is possible to improve the ejection efficiency and refill efficiency, and to raise the ejection speed.

In the movable member 20 shown in FIG. 13, the length of the movable member 20 (the length in the direction of flow of the liquid in the liquid chamber 14) is determined in such a manner that the free end 20A of the movable member 20 is arranged over the center of the position where the piezoelectric element 152 is arranged (the center in the left/right direction in FIG. 13). Furthermore, the width of the movable member 20 (the length in the direction perpendicular to the direction of flow of the liquid inside the liquid chamber 14, namely, the direction which passes through the plane of the drawing in FIG. 13) is determined so as to be substantially equal to the width of the piezoelectric element 152.

In FIG. 13, the detailed structure of the piezoelectric element 152 is not shown, but a lower electrode (ground electrode) is arranged on the surface of the piezoelectric element 152, on the side adjacent to the diaphragm 154, and an upper electrode (individual electrode) is provided on the surface of the piezoelectric element 152, on the side opposite to the diaphragm 154. In a mode where the diaphragm 154 is made of a metal material, it is possible to combine the lower electrode of the piezoelectric element 152 and the diaphragm 154.

Furthermore, it is possible to use a single-layer piezoelectric element or a laminated piezoelectric element for the piezoelectric element 152. Moreover, there are no restrictions on the operational mode of the piezoelectric element 152, and a $d_{31}$ mode or a $d_{33}$ mode may be employed. Of course, it is also possible to use other operational modes.

THIRD MODIFICATION EXAMPLE

Next, a third modification example of the present embodiment will be described with reference to FIGS. 14A to 14C. The movable member 20 (120) described above has a structure in which the first layer 24 is exposed on the four side faces (end faces) (See FIG. 1, for example). In the structure in which the first layer 24 having the tensile stress is exposed, cracks are liable to enter into the first layer 24 in the exposed portion. Therefore, the exposed portion of the first layer 24 may be covered by a material having compressive stress, as shown in FIGS. 14A to 14C, thereby preventing cracks from occurring in the first layer 24.

Figure 14A:
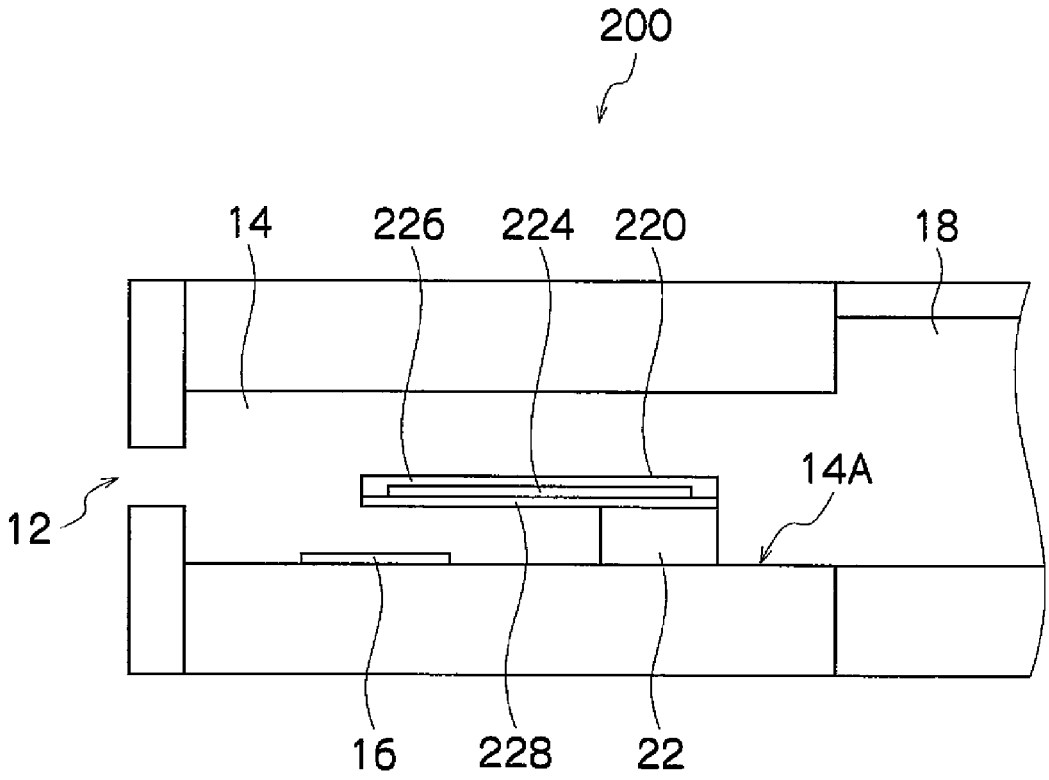
FIGS. 14A to 14C are cross-sectional diagrams showing the structure of a head according to a third modification example of the present embodiment.
Figure 14B:
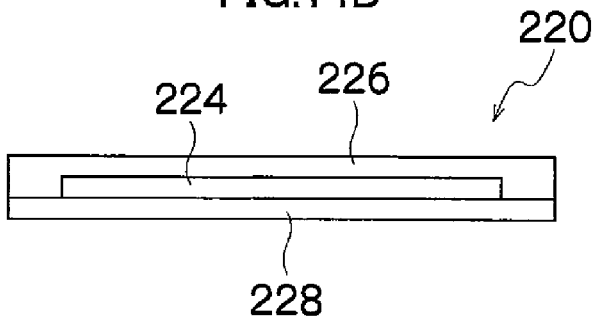
Figure 14C:
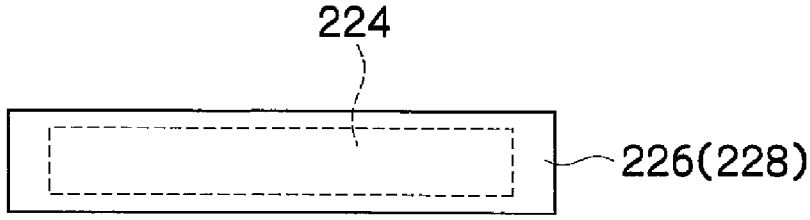

FIG. 14A is a cross-sectional diagram of a head 200 according to the third modification example, FIG. 14B is an enlarged cross-sectional diagram of the movable member 220 shown in FIG. 14A, and FIG. 14C is a plan diagram showing the movable member 220 shown in FIG. 14B as viewed from above.

As shown in FIG. 14A, the head 200 has the same structure as the head 10 shown in FIG. 1, except the structure of the movable member 220.

As shown in FIG. 14B, the second layer 226 comprises a recess shape which engages with the first layer 224 (the recess shape having the inverted shape of the first layer 224 and the same size as the first layer 224), thus achieving a structure in which the upper surface and the four side surfaces of the first layer 224 are covered. Furthermore, the third layer 228 is a flat plate-shape, being constituted so as to cover the bottom surface of the first layer 224, and it is bonded to the edges of the second layer 226. In other words, the movable member 220 has a structure in which the first layer 224 is not exposed, since the first layer 224 is accommodated in the space formed by the second layer 226 and the third layer 229, and the first layer 224 is covered completely by the second layer 226 and the third layer 228 (i.e., the first layer 224 is embedded in the second layer 226 and the third layer 228).

Figure 15A:
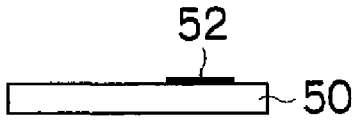
FIGS. 15A to 15O are step diagrams of the manufacture of a head according to a third modification example of the present embodiment.

FIGS. 15A to 15O are diagrams showing a schematic view of respective steps for fabricating the movable member 220 shown in FIGS. 14A to 14C, using a plating method. In FIGS. 15A to 15O, detailed description of the steps which are common to those in FIGS. 5A to 8H is omitted.

Figure 15B:
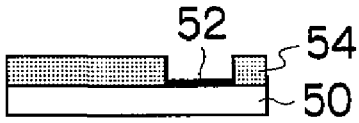
Figure 15C:
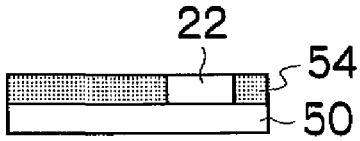

The movable member 220 can be formed by means of the plating method as follows. Firstly, a first plating electrode 52 for forming a fixing member 22 is formed on the substrate 50 (first plating electrode forming step, FIG. 15A), a first resist layer 54 is formed on the region where the first plating electrode 52 is not formed (first resist forming step, FIG. 15B), and a fixing member 22 is formed by electroforming (plating) (fixing member forming step, FIG. 15C).

Figure 15D:
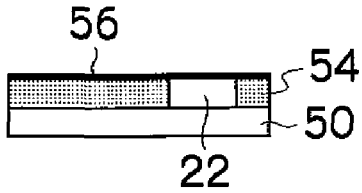
Figure 15E:
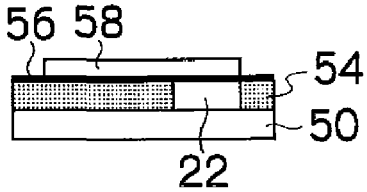
Figure 15F:
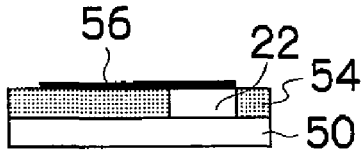
Figure 15G:
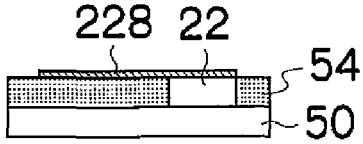

Next, a second plating electrode 56 is formed over the whole of the surface of the first resist layer 54 and the fixed member 22, on the side opposite to the substrate 50 (second plating electrode forming step, FIG. 15D), and furthermore, a second resist layer 58 having a pattern corresponding to the shape of the movable member 220 is formed on the surface of the second plating electrode 56 on the side opposite to the first resist layer 54 (second resist layer forming step, FIG. 15E), the second plating electrode 56 in the region which is not covered by the second resist layer 58 is removed, and the second resist layer 58 is then removed, thereby patterning the second plating electrode 56 in accordance with the shape of the of the movable member 220 (second plating electrode patterning step, FIG. 15F). The steps thus far are the same as the respective steps shown in FIGS. 8A to 8F.

Figure 15H:
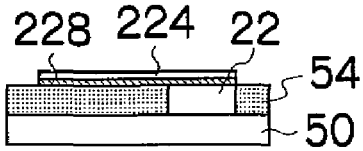
Figure 15I:
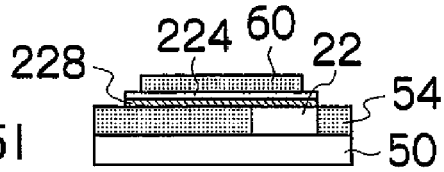

Thereupon, a third layer 228 is formed by electroforming (third layer film formation step), as shown in FIG. 15O, and a first layer 224 is formed on the surface of the third layer 228, on the opposite side to the fixing member 22 (first layer film formation step), as shown in FIG. 15H. Moreover, a third resist layer 60 is formed to serve as a mask for patterning the first layer 224 in such a manner that the perimeter portions (the four edge portions) of the first layer 224 are removed, as shown in FIG. 15I.

The third resist layer 60 is used for patterning the first layer 224 so that the first layer 224 is exposed about the perimeter of the third resist layer 60. In other words, the third resist layer 60 is used to form a biding margin between the third layer 228 and a second layer 226 which is to be formed subsequently.

Figure 15J:
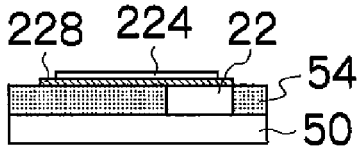
Figure 15K:
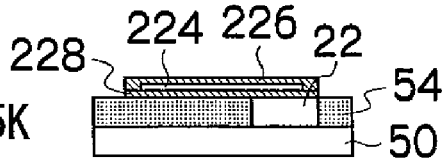

Thereupon, as shown in FIG. 15J, the portion of the first layer 224 which is exposed at the perimeter of the third resist layer 60 is removed, and the third resist layer 60 is also removed (first layer patterning step). Subsequently, as shown in FIG. 15K, a second layer 226 having a recess section corresponding to the first layer 224 is formed by electroforming (second layer forming step). In other words, the second layer 226 is formed so as to cover the surface of the first layer 224 opposite to the third layer 228, and the perimeter portions (side faces) of the first layer 224.

Figure 15L:
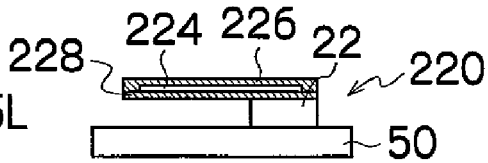

After the second layer 226 is deposited, the first resist layer 54 is removed (first resist layer removal step), thereby obtaining a movable member 220 having a first layer 224 which is covered by the second layer 226 and the third layer 228, and hence is not exposed, as shown in FIG. 15L.

It is also possible to omit the first layer patterning step for patterning the first layer 224 (see FIGS. 15T and 15J) in the manner described below.

Figure 15M:
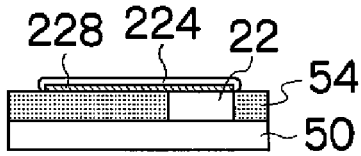
Figure 15N:
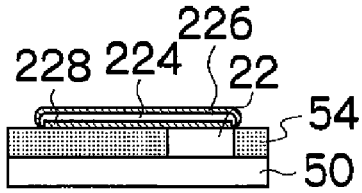

In other words, as shown in FIG. 15M, when the first layer 224 is formed, the plating conditions (for example, the plating time) are adjusted in such a manner that the first layer 224 covers the third layer 228, and the first layer 224 is formed so as to cover the surface of the third layer 228 on the side opposite the fixing member 22 and the four side faces, and furthermore, as shown in FIG. 15N, a second layer 226 is formed so as to cover completely the surface of the first layer 224 on the side opposite to the third layer 228, and the four side faces thereof.

Figure 150:
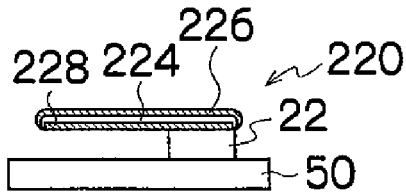

Thereupon, the first resist layer 54 is removed. By this means, a movable member 220 having a first layer 224 which is completely covered by the second layer 226 and the third layer 228 is obtained, as shown in FIG. 150.

In the second plating electrode patterning step shown in FIG. 15F, the first layer patterning step shown in FIG. 15J, and the first resist layer removal step shown in FIG. 15L, a chemical method, such as wet etching, is used. By this means, the possibility of cracks appearing in the first layer 224, the second layer 226 and the third layer 228 constituting the movable member 220 is reduced and improvement in the durability of the movable member 220 can be expected.

Next, the respective steps for manufacturing a movable member 220 using sputtering (CVD) are described, with reference to FIGS. 16A to 16K. In FIGS. 16A to 16K, detailed description of the steps which are common to those in FIGS. 9A to 9L is omitted.

Figure 16A:
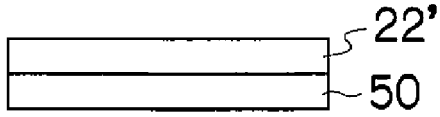
FIGS. 16A to 16K are step diagrams of another manufacture process that is different from the manufacture process shown in FIGS. 15A to 15O.
Figure 16B:
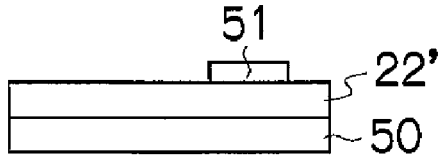
Figure 16C:
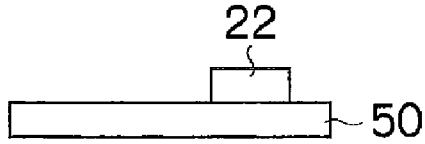

Firstly, as shown in FIG. 16A, a Layer 22' which is to become a fixing member is formed on a substrate 50 using sputtering (or CVD) (fixing member layer formation step). Thereupon, as shown in FIG. 16B, a resist layer 51 which is to become a mask is formed on the region of the layer 22' where a fixing member is to be formed on the surface opposite to the substrate 50, and as shown in FIG. 16C, the layer 22' is patterned to form a fixing member 22 (fixing member layer patterning step).

Figure 16D:
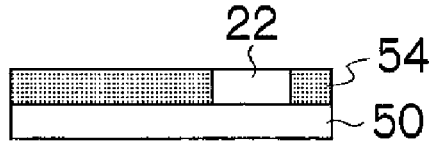

Thereupon, as shown in FIG. 16D, a first resist layer 54 is formed on the surface of the substrate 50 on which the fixing member 22 is formed (first resist layer forming step). The steps thus far are the same as the respective steps shown in FIGS. 9A to 9D.

Figure 16E:
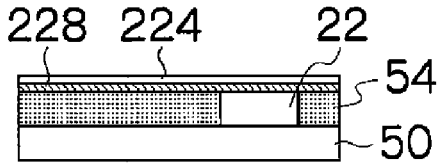

Thereupon, as shown in FIG. 16E, a third layer 228 is formed by sputtering (third layer formation step), and a first layer 224 is then formed by sputtering on the surface of the third layer 228 on the side opposite to the fixing member 22 (first layer formation step). The three layers which constitute the movable member 20 are formed by means of sputtering (or CVD) in the order, third layer 28, first layer 24, second layer 26, over the whole of the flat surface described above (movable member formation step).

Figure 16F:
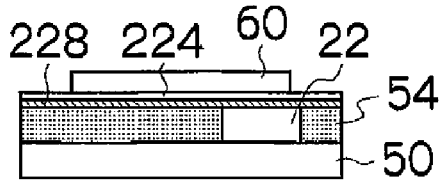

Here, as shown in FIG. 16F, a third resist layer 60 is formed to serve as a mask for patterning the first layer 224 in such a manner that the perimeter portions (the four edge portions) of the first layer 224 are removed (third resist layer forming step).

The third resist layer 60 is used for patterning the first layer 224 so that the first layer 224 is exposed at the perimeter of the third resist layer 60. In other words, the third resist layer 60 is used to form a portion which serves as a binding margin between the third layer 228 and a second layer 226 which is to be deposited subsequently.

Figure 16G:
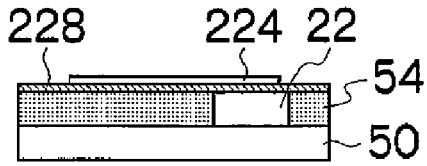
Figure 16H:
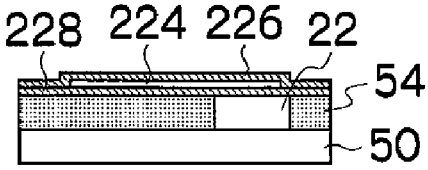

Thereupon, as shown in FIG. 16G, the portion of the first layer 224 which is exposed at the perimeter of the third resist layer 60 is removed, and furthermore the third resist layer 60 is removed (first layer patterning step). Subsequently, a second layer 226 is formed by sputtering, as shown in FIG. 16H (second layer forming step). The second layer 226 is formed over the surface of the first layer 224 on the side opposite to the third layer 228, and the perimeter portions (side faces) of the first layer 224.

Figure 16I:
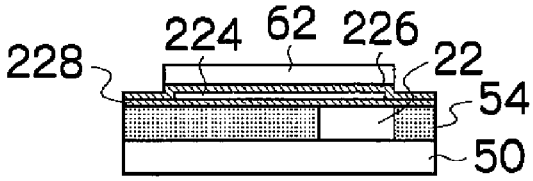

After the second layer 226 is formed, as shown in FIG. 16I, a mask pattern (fourth resist layer) 62 is formed in order to pattern the second layer 226 and the third layer 228 and thereby to create the shape of the movable member 220 (fourth resist layer forming step). Next, as shown in FIG. 16J, the portions of the second layer 226 and the third layer 228 which are not covered by the fourth resist layer 62 are removed (coating layer patterning step), and furthermore, the first resist layer 54 is removed (first resist layer removal step), thereby forming a movable member 220 having a first layer 224 which is covered by the second layer 226 and the third layer 228, as shown in FIG. 16K.

Figure 16J:
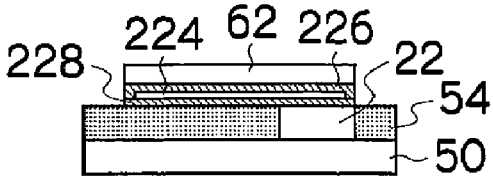
Figure 16K:
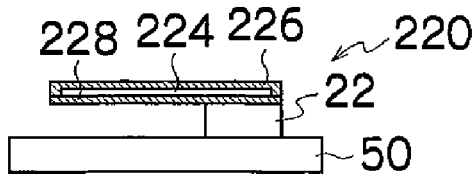

In the first layer patterning step shown in FIG. 16Q the coating layer patterning step shown in FIG. 16J and the first resist layer removal step shown in FIG. 16K, a chemical method, such as wet etching, is used. By this means, the possibility of cracks appearing in the first layer 224, the second layer 226 and the third layer 228 constituting the movable member 220 in these steps is reduced and improvement in the durability of the movable member 220 can be expected.

According to the third modification example described above, since the first layer 224 of the movable member 220, which has tensile stress, is composed so as to be covered completely by the second layer 226 and the third layer 228 which has compressive stress, then the first layer 224 is not exposed and the overall durability of the movable member 220 as a whole is improved. Furthermore, since a chemical technique such as wet etching is used to pattern the first layer 224, the second layer 226 and the third layer 228, rather than a physical technique such as dry etching, then cracks are prevented from appearing in the movable member 220 during the process, and improved durability of the movable member 220 can be expected.

FOURTH MODIFICATION EXAMPLE

Figure 17:
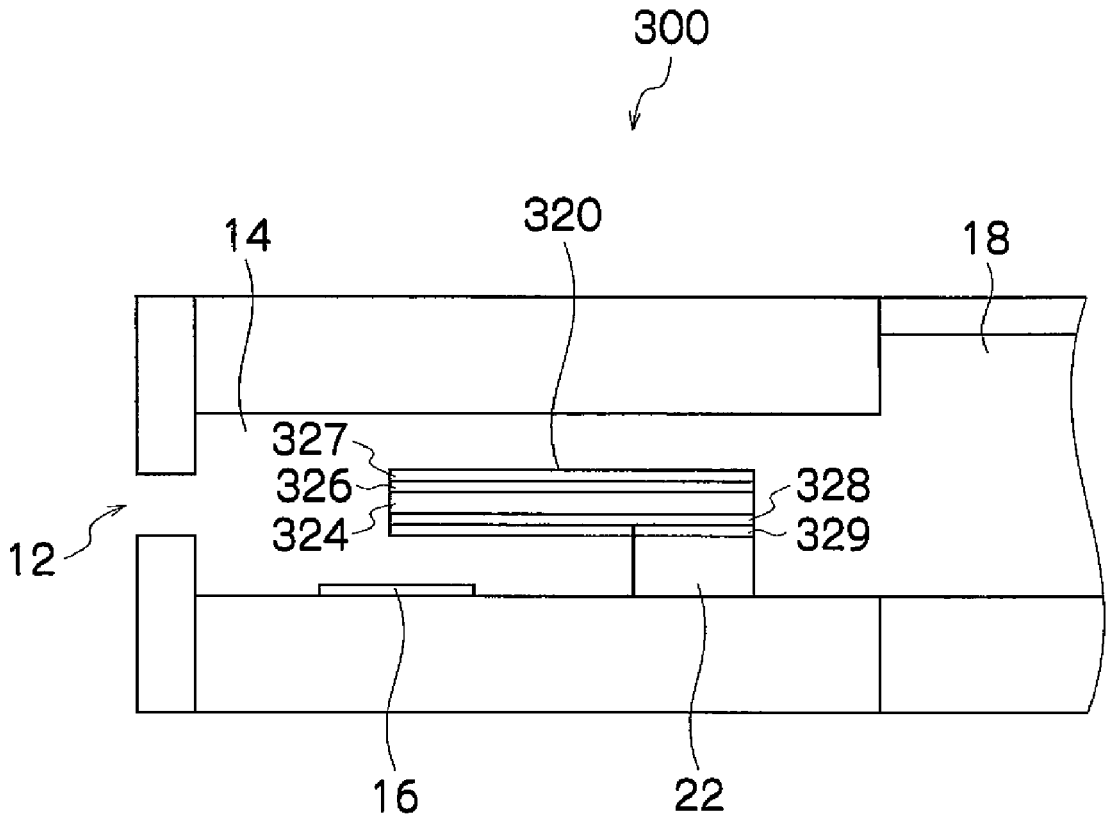
FIG. 17 is a cross-sectional diagram showing the structure of a head according to a fourth modification example of the present embodiment.

Next, a fourth modification example of the present embodiment will be described. FIG. 17 is a cross-sectional diagram of the head 300 according to the fourth modification example. The head 300 shown in FIG. 17 comprises a movable member 320 constituted of five layers, inside the liquid chamber 14. In the head 300 shown in FIG. 17, the composition apart from the movable member 320 is the same as that of the head 10 shown in FIG. 1, and description of this common structure is omitted here.

Figure 18:
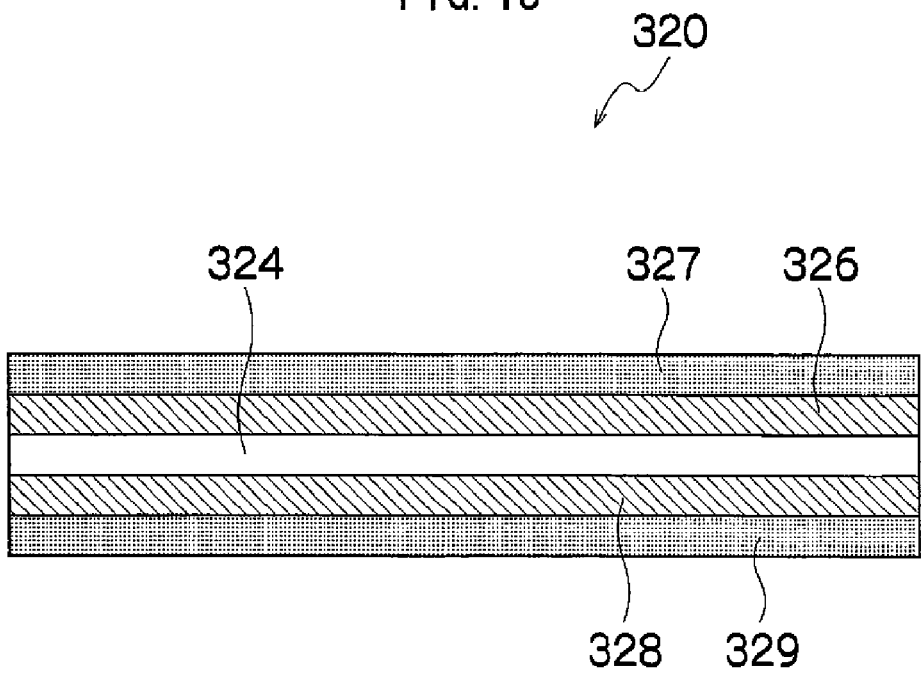
FIG. 18 is an enlarged diagram of the movable member shown in FIG. 17.

FIG. 18 is a diagram showing an enlarged view of the movable member 320 shown in FIG. 17. As shown in FIG. 18, in the movable member 320, a second layer 326 having a compressive stress is layered onto a surface of the first layer 324 having tensile stress, on the side opposite to the fixing member 22 (not shown in FIG. 18). Moreover, a fourth layer 327 having a lower compressive stress (greater absolute stress value) than the second layer 326 is layered onto the second layer 326 on the side opposite to the first layer 324.

Similarly, a third layer 328 having compressive stress is layered onto the other surface of the first layer 324 on the side adjacent to the fixing member 22 (the surface on the side opposite to the second layer 326), and moreover, a fifth layer 329 having a lower compressive stress (greater absolute stress value) than the third layer 328 is layered onto the opposite side of the third layer 328 from the first layer 324.

In other words, in the movable member 320 shown in FIG. 18, a plurality of layers (i.e., a set of the layers 326 and 327 or a set of the layers 328 and 329) having compressive stress are arranged on both surfaces of the internal layer (i.e., the first layer 324), and the outer one (i.e., the fourth layer 327 or the fifth layer 329) of these layers has a compressive stress lower (the absolute stress value is greater) than the inner one (i.e., the second layer 326 or the third layer 328) of these layers.

More specifically, the relationship between the stress of the second layer 326 shown in FIG. 18 and the stress of the fourth layer 327 is such that the stress of the second layer 326 is greater than the stress of the fourth layer 327. Similarly, the relationship between the stress of the third layer 328 and the stress of the fifth layer 329 is such that the stress of the third layer 328 is greater than the stress of the fifth layer 329.

FIG. 17 and FIG. 18 show an example of a movable member 320 comprising a total of five layers, in which two layers (the second layer 326 and the fourth layer 327) are formed on one surface of one tensile stress layer (the first layer 324), and two layers (the third layer 328 and the fifth layer 329) are formed on the other surface thereof thus layering a total of four compressive stress layers. However, it is also possible to arrange three or more compressive stress layers on both sides of the internal layer. In a mode where compressive stress layers which are laminated on one surface and the other surface of the first layer 324 are each constituted by three or more layers, then the stresses of the respective layers are determined in such a manner that the stress of the outer layers is lower than the stress of the layer on the side adjacent to the first layer 324 (the internal layer). Thus, the stress of the compressive stress layers arranged on the outer side of the first layer 324 may be reduced gradually from the side adjacent to the first layer, toward the outer side. In other words, the farther a layer locates from the internal layer (i.e., the first layer 324), the lower the stress of that layer is.

By gradually reducing the stress of the compressive stress layers from the inner side to the outer side in this way, sudden stress variations between the layers are eliminated and detachment between layers or breaking of the layers is prevented.

Figure 19:
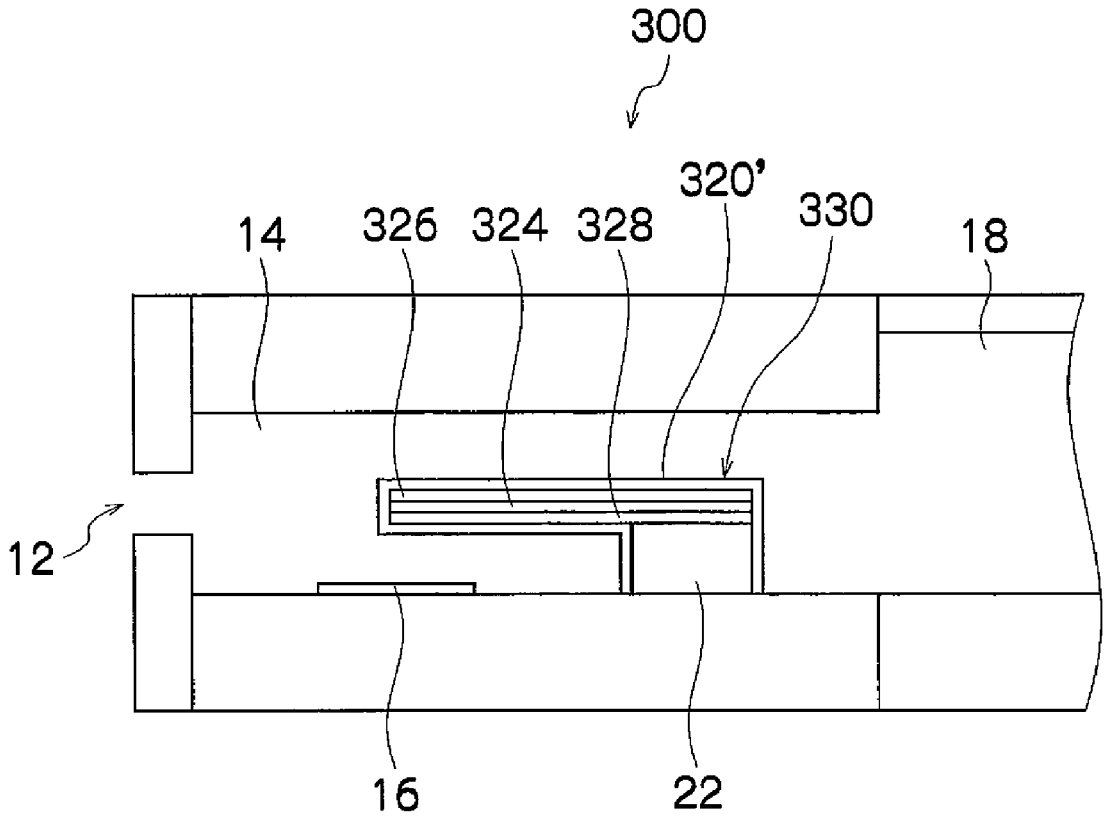
FIG. 19 is a cross-sectional diagram showing a further mode of the structure of a head according to a fourth modification example of the present embodiment.

Furthermore, a desirable mode is one in which a film 330 having liquid resistant properties is provided on the liquid contacting surface which makes contact with the liquid inside the liquid chamber 14 as shown in FIG. 19. In the mode shown in FIG. 19, a liquid resistant film 330 is formed over all of the surfaces of the movable member 320' and the fixing member 22 which make contact with the liquid. The movable member 320' shown in FIG. 19 is constituted by three layers, but it is also possible to adopt a movable member 320 constituted by five layers as shown in FIG. 17 and FIG. 18 or a movable member comprising a greater number of layers.

FIFTH MODIFICATION EXAMPLE

Figure 20:
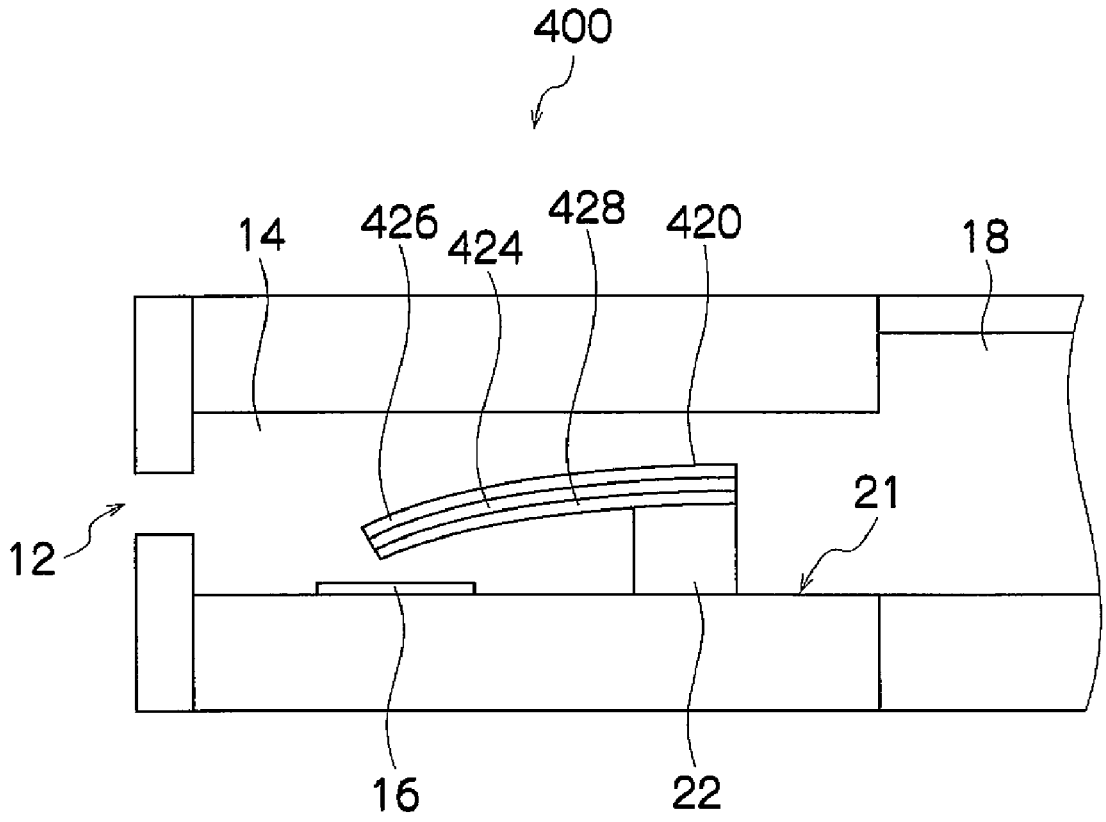
FIG. 20 is a cross-sectional diagram showing the structure of a head according to a fifth modification example of the present embodiment.

Next, a fifth modification example of the present embodiment will be described. In the head 400 shown in FIG. 20, the first layer 424 is interposed between the second layer 426 and the third layer 428 that have mutually different stresses. As shown in FIG. 20, the movable member 420 is warped toward one side due to the difference of the stress between the second layer 426 and the third layer 428.

The movable member 420 shown in FIG. 20 has a structure in which the second layer 426 and the third layer 428 are formed in such a manner that the stress of the third layer 428 which is laminated onto the lower side of the first layer 424 is greater than the stress of the second layer 426 which is laminated onto the upper side of the first layer 424, and hence the whole movable member 420 is warped toward the side of the third layer 428 (the side of the layer having the greater stress).

If there is a difference in stress between the two compressive stress layers which are laminated onto the two surfaces of the tensile stress layer, due to manufacturing variations, then warping occurs toward the side of the layer having greater stress. On the other hand, it is difficult to make the stress values of the two layers laminated onto either surface of the tensile stress layer coincide completely, and if a movable member is manufactured without controlling the stresses of the two layers, then a movable member which is warped toward the second layer 426 and a movable member which is warped toward the third layer 428 are produced, as a result of manufacturing variation. In other words, the variations of the warping direction of the movable member occur due to the manufacturing variations.

In order to prevent the variations of the warping direction of the movable member, it is preferable to cause the movable member 420 to warp in a previously determined direction (in the mode shown in FIG. 19, toward the heater 16 side) by controlling the conditions of the film formation processes during the manufacture of the movable member 420 in such a manner that the stress of the third layer 428 is greater than the stress of the second layer 426, and hence variation in the initial position (stationary position) of the movable member 420 can be suppressed.

For example, by making the third layer 428 thinner than the second layer 426, it is possible to make the stress of the third layer 428 greater than the second layer 426. Of course, it is also possible to make the stress of the third layer 428 greater than the second layer 426, by varying the composition of the second layer 426 and the third layer 428.

Figure 21A:
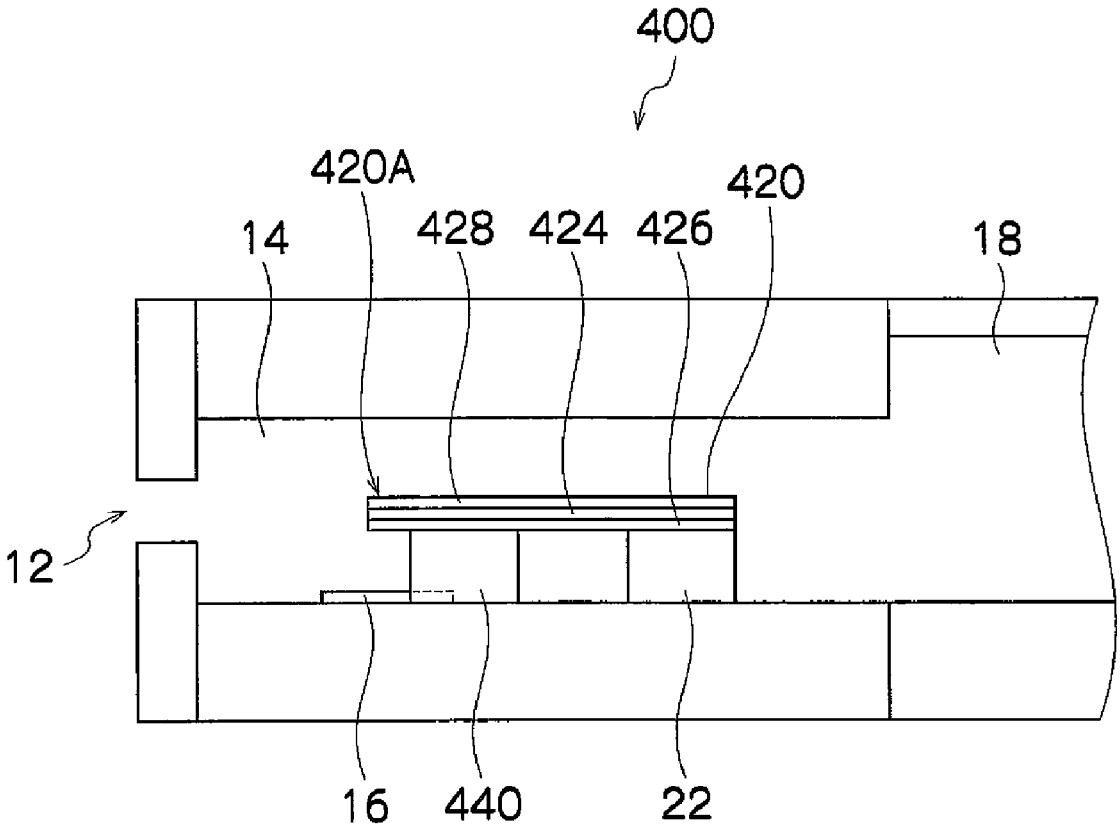
FIGS. 21A and 21B are cross-sectional diagrams showing a further example of the structure of the head shown in FIG. 20.
Figure 21B:
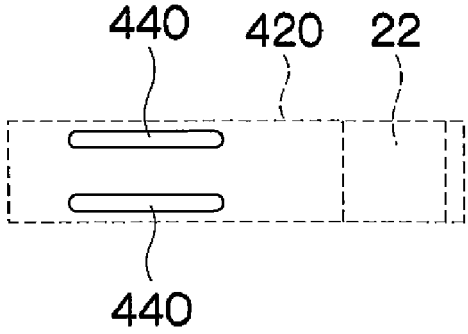

A desirable mode is one in which a restricting member 440 is arranged as shown in FIGS. 21A and 21B, and the restricting member 440 supports the free end 420A of the movable member 420 from the underside of the movable member 420 and acts as a stopper for the movable member 420, in such a manner that the movable member 420 does not warp excessively.

FIG. 21B is a diagram showing one example of the structure of a restricting member 440, FIG. 21B is a diagram showing a restricting member 440 as viewed from the side of the movable member 420, and the movable member 420 is depicted by dotted lines. The restricting member 440 shown in FIG. 21B includes two plate-shaped members which are arranged following a parallel direction to the direction of flow of the liquid in the liquid chamber 14 (the direction parallel to the lengthwise direction of the movable member 420), and hence these members support end portions of the movable member 420 in the breadthways direction, while the central portion and the vicinity of the movable member 420 is left unsupported (void).

As shown in FIG. 21B, by supporting only the both end portions of the movable member 420 in the breadthways direction by means of the restricting member 440, while leaving the central portion and the vicinity thereof unsupported (void), then there is no obstruction to the flow of liquid inside the liquid chamber 14, and furthermore, there is no obstruction to the gas bubble inside the liquid chamber 14. Moreover, a desirable mode is one which employs a structure where the corner portions of the restricting member 440 are formed with a rounded shape, or a structure where the width of the restricting member 440 in the direction perpendicular to the direction of flow of the liquid in the liquid chamber 14 is reduced.

Figure 22A:
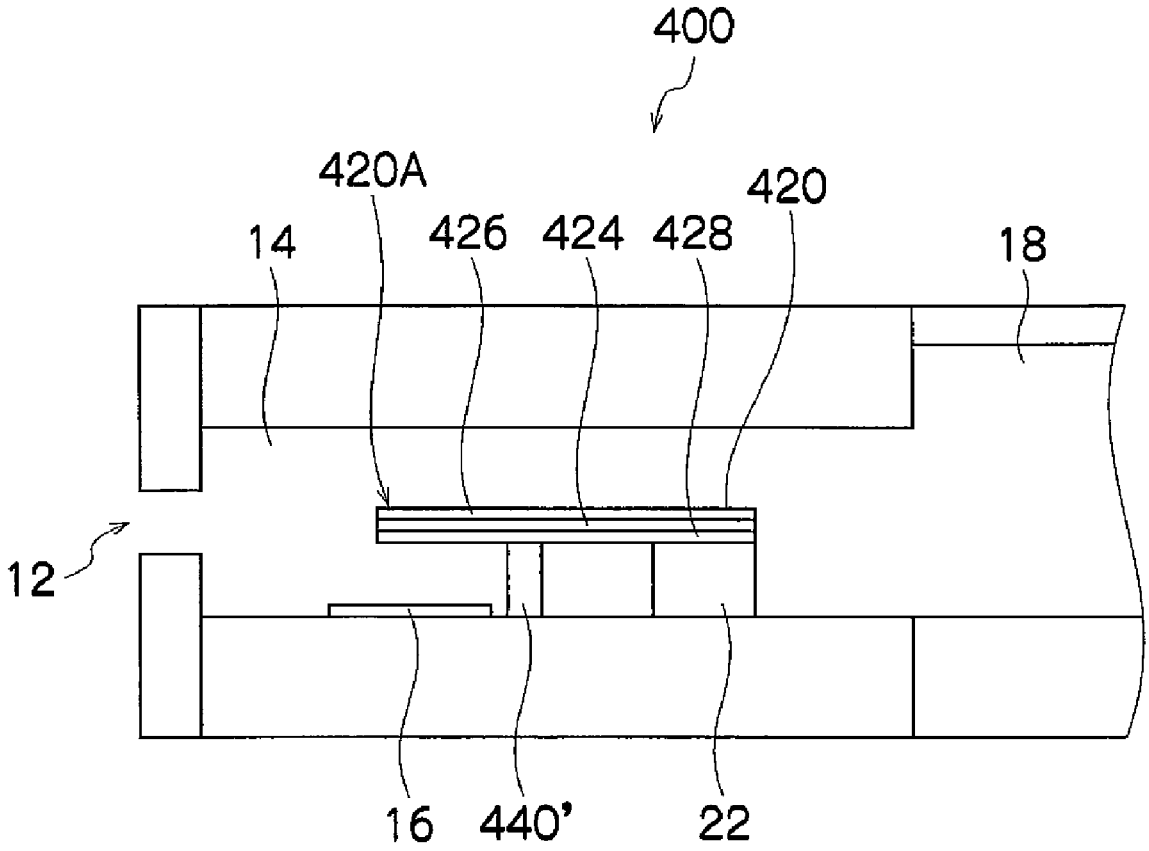
FIGS. 22A and 22B are cross-sectional diagrams showing a further example of the structure of the restricting member shown in FIGS. 21A and 21B.
Figure 22B:
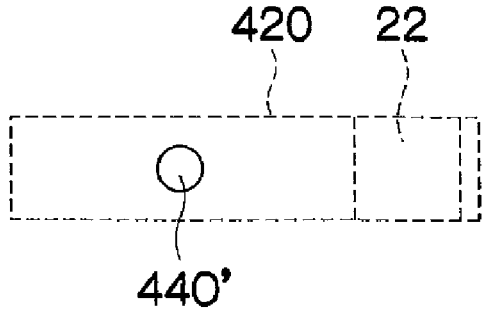

FIGS. 22A and 22B are diagrams showing further examples of the structure of the restricting member. The restricting member 440' shown in FIGS. 22A and 22B has a cylindrical bar shape which supports the central portion of the movable region of the movable member 420 (the region which is not supported by the fixing member 22), from below.

The restricting member 440 shown in FIGS. 21A and 21B and the restricting member 440' shown in FIGS. 22A and 22B can be formed by using a method similar to the method of forming the fixing member 22. For example, one possible method of forming the restricting member 440 (440') is a method where a plating electrode is formed at the restricting member 440 forming position, a mask (resist) pattern is formed on the restricting member 440 non-forming section, the restricting member 440 is formed by plating, and the mask pattern is then removed.

In order to prevent contact between the movable member 420 and the restricting member 440, it is also possible to form an extremely thin resin layer on the portion of the restricting member 440 which makes contact with the movable member 420, before forming the movable member 420, and to then form the movable member 420 and subsequently remove the resin layer. The resin layer can be removed by a chemical method or a physical method, and it is suitable to use a resist, or the like.

According to the fifth modification example described above, the compressive stresses of the layers having compressive stress can be determined in such a manner that the movable member 420 is warped toward the lower side (the bottom surface of the liquid chamber 14) in an initial state, and therefore variations in the initial position of the movable member 420 due to manufacturing variations can be prevented. Moreover, by providing a restricting member 440 (440') which supports the movable member 420 from the bottom surface side of the liquid chamber 14, then even if the movable member 420 warps excessively, displacement in the initial position is prevented.

SIXTH MODIFICATION EXAMPLE

Figure 23:
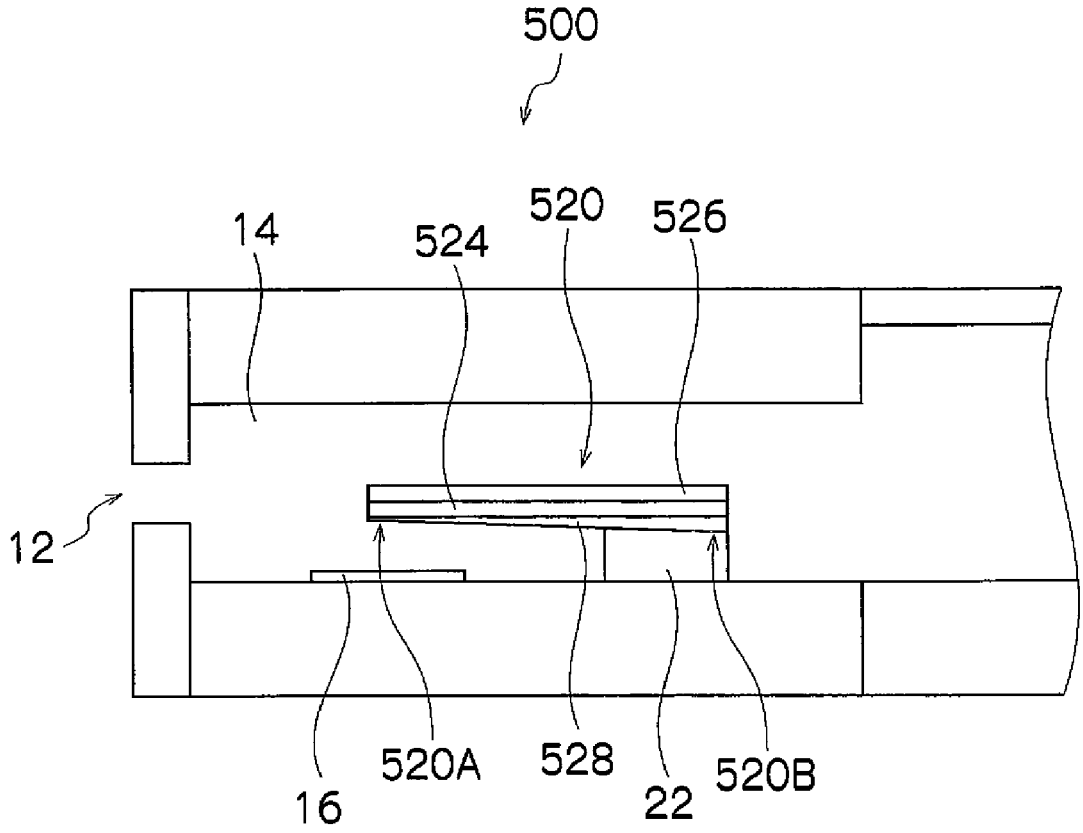
FIG. 23 is a cross-sectional diagram showing the structure of a head according to a sixth modification example of the present embodiment.

Next, a sixth modification example of the present embodiment will be described. FIG. 23 is a cross-sectional diagram of the head 500 according to the sixth modification example. As shown in FIG. 23, in the movable member 520 provided in the head 500, the thickness of the third layer 528 changes and becomes larger from the free end 520A toward the fixed end 520B.

Figure 24:
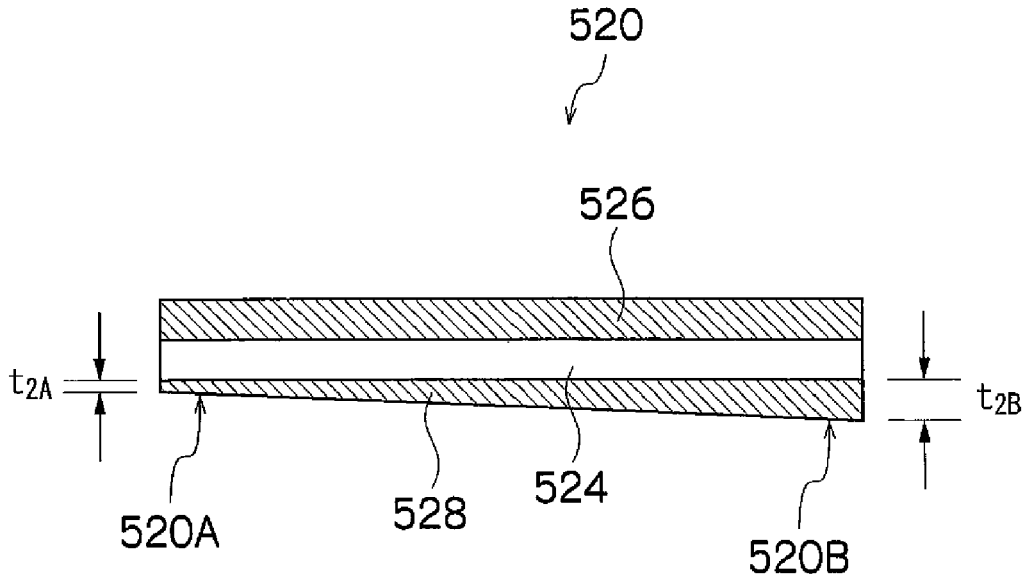
FIG. 24 is an enlarged diagram of the movable member shown in FIG. 23.

FIG. 24 is a diagram showing an enlarged view of the movable member 520 shown in FIG. 23. In the movable member 520 shown in FIG. 24, the thickness $t_{2A}$ of the end portion of the free end 520A of the third layer 528 and the thickness $t_{2B}$ of the end portion on the side of the fixed end 520B have a relationship of $0<t_{2A}<t_{2B}$.

In other words, in the movable member 520 shown in FIG. 24, the stress in the third to layer 528 changes with the position in the lengthwise direction, and the stress gradually decreases from the side of the free end 520A toward the side of the fixed end 520B.

When the movable member 520 is deformed, a greater force is applied to the side of the fixed end 520B than to the side of the free end 520A, and cracks are most liable to appear in the base portion of the movable member 520 (the vicinity of the boundary between the region where the fixed end 520B is supported by the fixing member 22 and the movable region). Consequently, it is possible to raise the durability of the portion where cracks are most liable to occur, thus protecting the movable member, by increasing the thickness on the fixed end 520B side compared to the free end 520A side. Furthermore, it is also possible to expand the range of possible movement by forming the free end 520A side to have a smaller thickness, and therefore improvement in ejection efficiency can be expected.

It is desirable if the thickness $t_{2A}$ of the end portion on the side of the free end 520A is set to 0.5 μm, and the thickness $t_{2B}$ of the end portion on the side of the fixed end 520B is set to 2.0 μm, since this makes it possible to achieve both good characteristics and good manufacturability in the movable member 520.

Figure 25A:
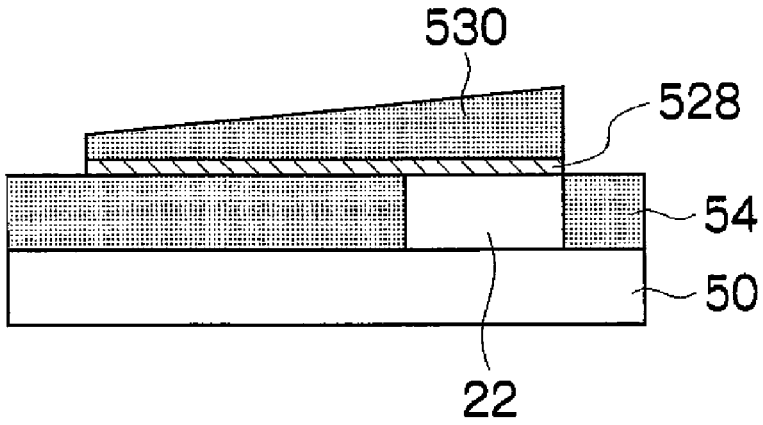
FIGS. 25A to 25C are step diagrams of the manufacture of the movable member shown in FIG. 23.
Figure 25B:
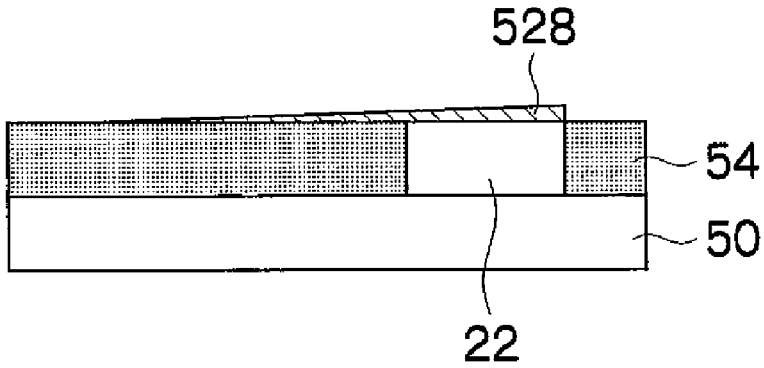
Figure 25C:
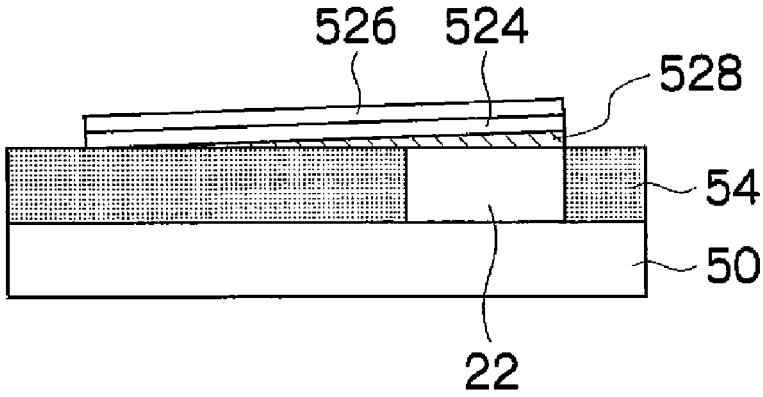

To give one example of a method of manufacturing the movable member 520 shown in FIG. 24, after forming a third layer 528 as shown in FIG. 25A, a resist layer 530 having a tapered shape which gradually increases in thickness from the free end 520A side of the movable member 520 toward the fixed end 520B side is formed on the opposite surface of the third layer 528 from the fixed member 22. In this state (i.e., the state shown in FIG. 25A), a dry etching process is carried out, thereby forming a third layer 528 having an inclined surface of which the thickness gradually increases from the free end 520A side toward the fixed end 520B side, as shown in FIG. 25B. Thereupon, as shown in FIG. 25C, a first layer 524 and a second layer 526 are stacked on the third layer 528, and the resist layer 54 is then removed, thereby completing the movable member 520.

It is possible to taper the resist layer 530 by altering the exposure conditions of the resist layer 530 (and more specifically, by exposing through a gray mask, or the like).

Figure 26:
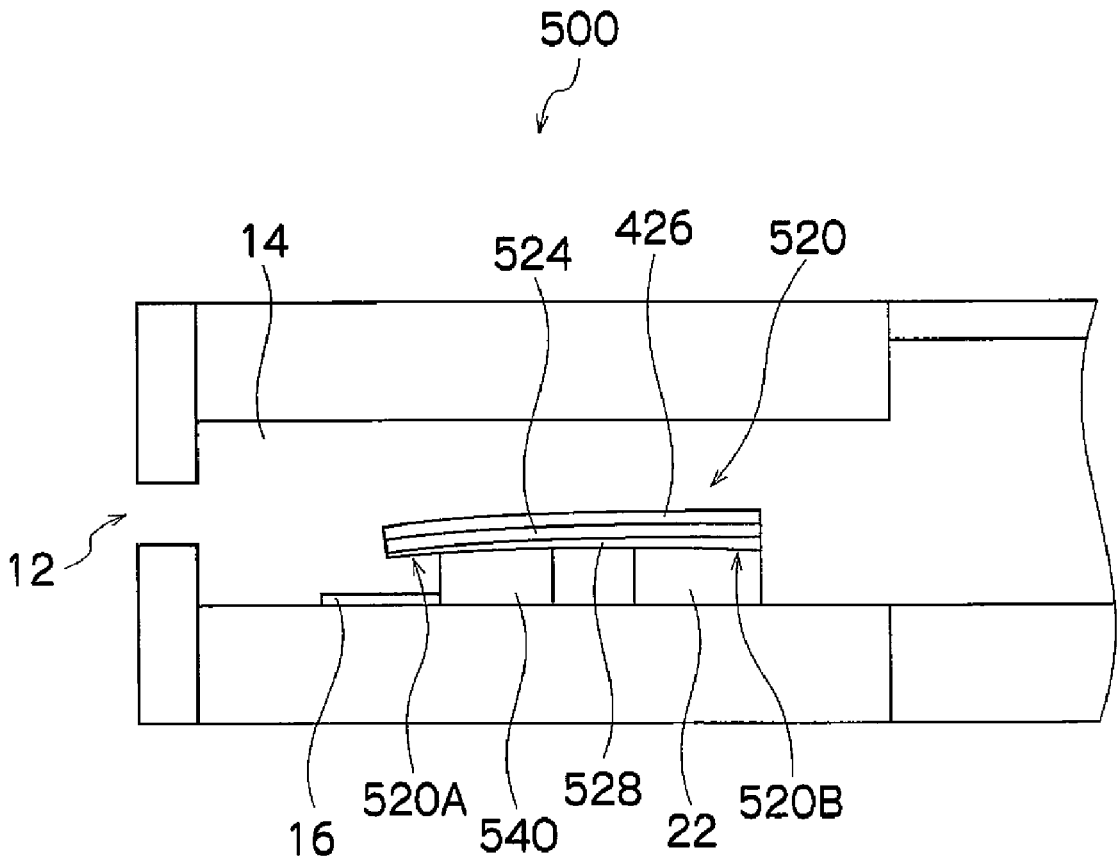
FIG. 26 is a cross-sectional diagram showing a further example of the structure of the head shown in FIG. 23.

Since the free end 520A of the movable member 520 shown in FIG. 24 warps readily in the downward direction, then a desirable mode is one where a restricting member 540 which restricts the warping of the movable member 520 is arranged as shown in FIG. 26. The restricting member 540 shown in FIG. 26 has the same shape and function as the restricting member 440 shown in FIGS. 21A and 21B or the restricting member 440' shown in FIGS. 22A and 22B. Moreover, the restricting member 540 can be formed in the same manner as the restricting members 440 and 440'.

Example of Overall Composition of Apparatus

Figure 27:
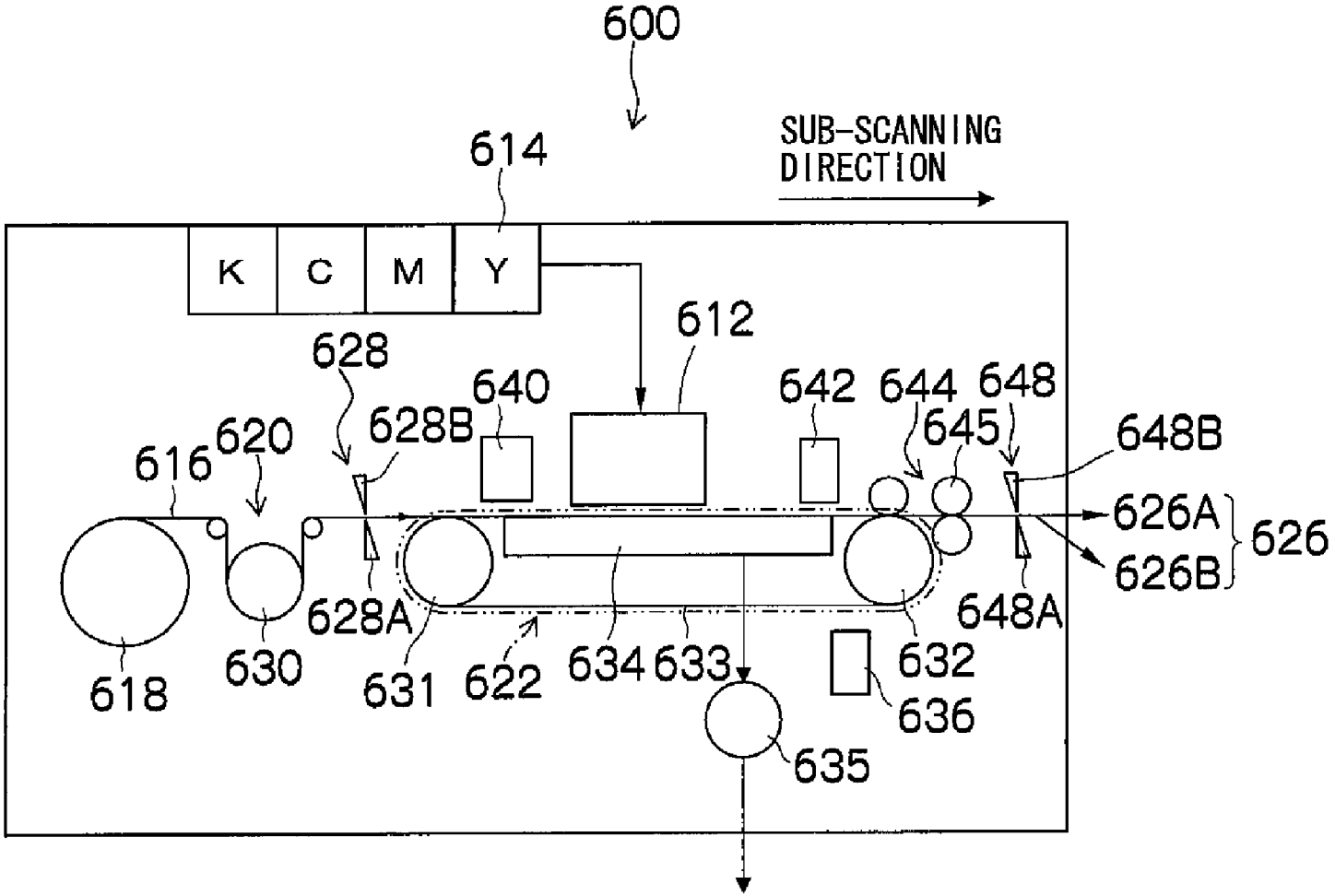
FIG. 27 is a general schematic drawing of an inkjet recording apparatus according to an embodiment of the present invention.

Next, an example of the composition of an apparatus according to an embodiment of the present invention in which the head described above is installed will be explained. FIG. 27 is a diagram showing the approximate composition of an inkjet recording apparatus 600 which forms prescribed images on a recording medium by ejecting ink from the head described above.

General Composition of Apparatus

As shown in FIG. 27, the inkjet recording apparatus 600 comprises: a print unit 612 having a plurality of inkjet heads (hereinafter, called "heads") which are provided to correspond to the respective inks of the colors of black (K), cyan (C), magenta (M) and yellow (Y); an ink storing and loading unit 614 which stores inks to be supplied to the heads; a paper supply unit 618 which supplies a recording paper 616 that forms a recording medium; a decurling unit 620 which removes curl from the recording paper 616; a suction belt conveyance unit 622, disposed so as to oppose the nozzle surfaces of the heads, which conveys the recording paper 616 while keeping the recording paper 616 flat; and a paper output unit 626 which outputs the recorded recording paper printed matter), to the exterior.

The ink storing and loading unit 614 has ink supply tanks (not shown in FIG. 27, and indicated by reference numeral 660 in FIG. 31) for storing the inks to be supplied to the heads, and the inks of the respective colors are connected to the heads via prescribed ink flow channels.

The ink storing and loading unlit 614 has a warning device (for example, a display device or an alarm sound generator) for warning when the remaining amount of any ink is low, and has a mechanism for preventing loading errors among the colors. The details of the ink supply system including the ink storing and loading unit 614 shown in FIG. 27 are described below.

In FIG. 27, a magazine for rolled paper (continuous paper) is shown as an example of the paper supply unit 618; however, a plurality of magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 616 delivered from the paper supply unit 618 retains curl due to having been loaded in the magazine. In order to remove the curl, heat is applied to the recording paper 616 in the decurling unit 620 by a heating drum 630 in the direction opposite from the curl direction in the magazine. The heating temperature at this time is preferably controlled so that the recording paper 616 has a curl in which the surface on which the print is to be made is slightly round outward.

In the case of the configuration in which roll paper is used, a cutter (first cutter) 628 is provided as shown in FIG. 27, and the continuous paper is cut into a desired size by the cutter 628. The cutter 628 has a stationary blade 628A, whose length is not less than the width of the conveyor pathway of the recording paper 616, and a round blade 628B, which moves along the stationary blade 628A. The stationary blade 628A is disposed on the reverse side of the printed surface of the recording paper 616, and the round blade 628B is disposed on the printed surface side across the conveyor pathway. When cut papers are used, the cutter 628 is not required.

The decurled and cut recording paper 616 is delivered to the suction belt conveyance unit 622. The suction belt conveyance unit 622 has a configuration in which an endless belt 633 is set around rollers 631 and 632 so that the portion of the endless belt 633 facing at least the nozzle face of the head forms a horizontal plane (flat plane).

The belt 633 has a width that is greater than the width of the recording paper 616, and a plurality of suction apertures (not shown) are formed on the belt surface. A suction chamber 634 is disposed in a position facing the nozzle surface of the head on the interior side of the belt 633, which is set around the rollers 631 and 632, as shown in FIG. 27. The suction chamber 634 provides suction with a fan 635 to generate a negative pressure, and the recording paper 616 is held on the belt 633 by suction.

The belt 633 is driven in the clockwise direction in FIG. 27 by the motive force of a motor (not shown in FIG. 27 and indicated by reference numeral 688 in FIG. 32) being transmitted to at least one of the rollers 631 and 632, which the belt 633 is set around, and the recording paper 616 held on the belt 633 is conveyed from left to right in FIG. 27.

Since ink adheres to the belt 633 when a marginless print job or the like is performed, a belt-cleaning unit 636 is disposed in a predetermined position (a suitable position outside the printing area) on the exterior side of the belt 633. Although the details of the configuration of the belt-cleaning unit 636 are not shown, examples thereof include a method of nipping with a brush roller and a water absorbent roller or the like, an air blowing method in which clean air is blown onto the belt, or a combination of these. In the method of nipping with the cleaning rollers, it is preferable to make the line velocity of the cleaning rollers different than that of the belt to improve the cleaning effect.

The inkjet recording apparatus 10 can comprise a roller nip conveyance mechanism, in place of the suction belt conveyance unit 622. However, there is a drawback in the roller nip conveyance mechanism that the print tends to be smeared when the printing area is conveyed by the roller nip action because the nip roller makes contact with the printed surface of the paper immediately after printing. Therefore, as shown in the present example, the suction belt conveyance in which nothing comes into contact with the image surface in the printing area is preferable.

A heating fan 640 is disposed on the upstream side of the print unit 612 in the conveyance pathway formed by the suction belt conveyance unit 622. The heating fan 640 blows heated air onto the recording paper 616 to heat the recording paper 616 immediately before printing so that the ink deposited on the recording paper 616 dries more easily.

The heads of the print unit 612 are full line heads having a length corresponding to the maximum width of the recording paper 616 used with the inkjet recording apparatus 600, and comprising a plurality of nozzles for ejecting ink arranged on a nozzle face through a length exceeding at least one edge of the maximum-size recording medium (namely, the full width of the printable range).

Figure 28:
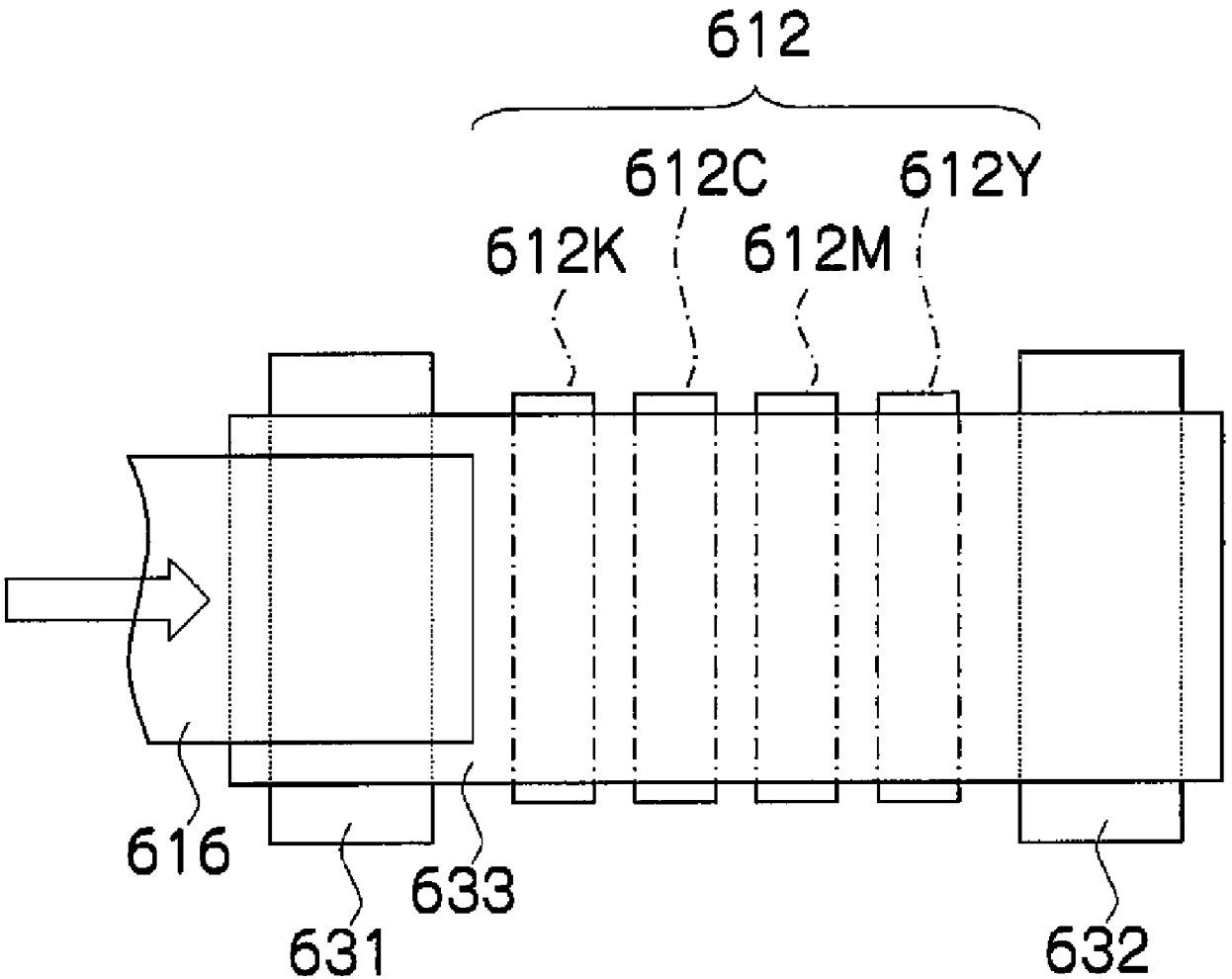
FIG. 28 is a principal plan diagram of the peripheral area of a print unit in the inkjet recording apparatus illustrated in FIG. 27.

FIG. 28 is a diagram showing the general composition of a print unit 612. As shown in FIG. 28; the heads of the respective colors are disposed in the color order: black (612K), cyan (621C), magenta (612M), yellow (612Y), from the upstream side following the direction of conveyance of the recording paper 616, and the respective heads are fixed so as to extend in the direction of conveyance of the recording paper 616 (the paper conveyance direction).

A color image can be formed on the recording paper 616 by ejecting inks of different colors from the heads, respectively, onto the recording paper 616 while the recording paper 616 is conveyed by the suction belt conveyance unit 622.

By adopting a configuration in which the full line heads 612K, 612C, 612M and 612Y having nozzle rows covering the full paper width are provided for the respective colors in this way, it is possible to record an image on the full surface of the recording paper 616 by performing just one operation of relatively moving the recording paper 616 and the print unit 612 in the paper conveyance direction, in other words, by means of a single sub-scanning action. By adopting a composition which is capable of single-pass printing in this way, higher-speed printing is thereby made possible and productivity can be improved in comparison with a serial type head configuration in which a recording head moves reciprocally in a direction which is perpendicular to the paper conveyance direction.

Figure 29:
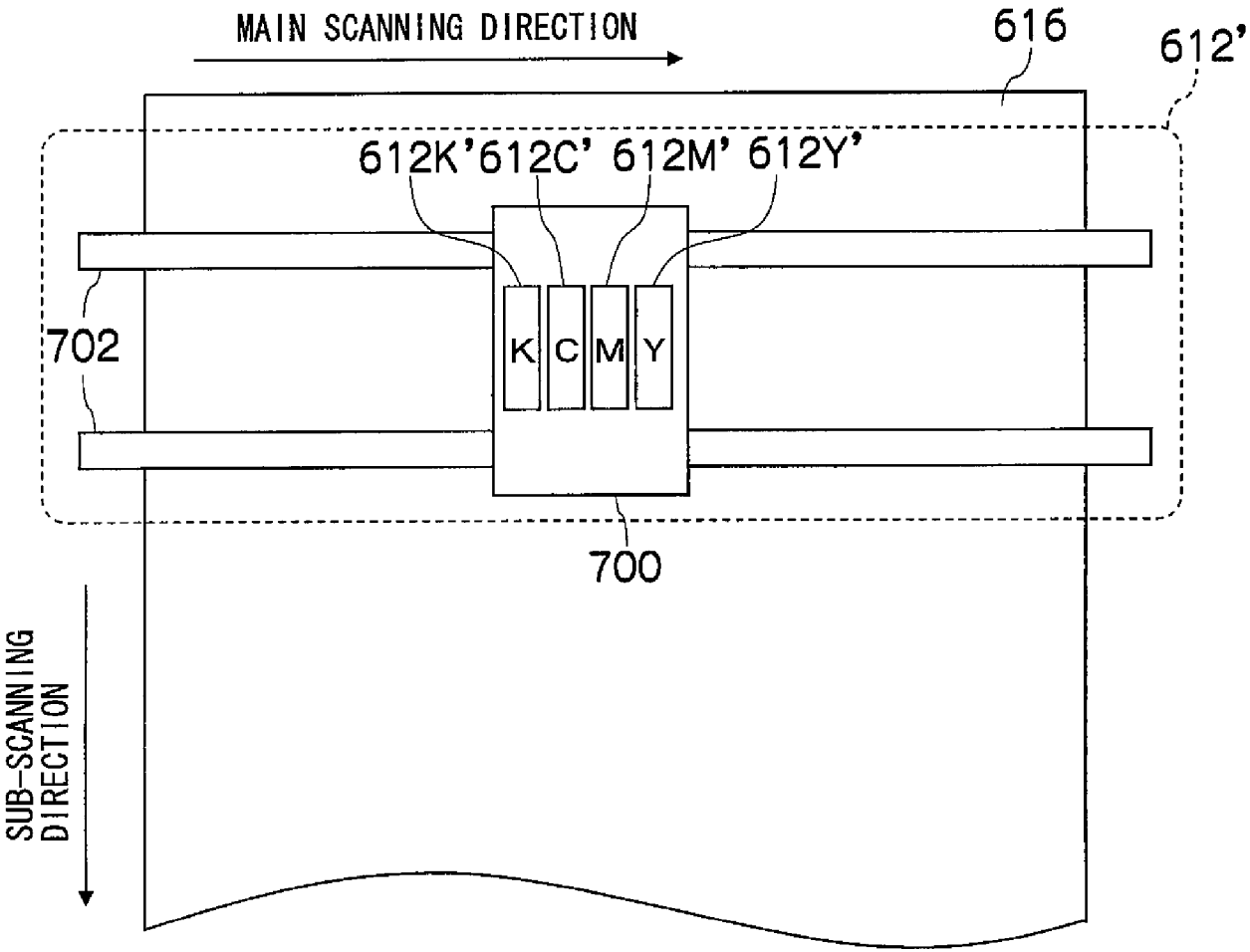
FIG. 29 is a principal plan diagram of the periphery of a print unit according to a further mode of the print unit shown in FIG. 28.

FIG. 29 is a diagram showing the general composition of a print unit 612' in an inkjet recording apparatus having a serial type of head. As shown in FIG. 29, a carriage 700 on which the heads 612K', 612C', 612M', 612Y' corresponding to the respective colors are mounted following the main scanning direction, and a guide 702, disposed following the main scanning direction, which supports the carriage 700, are provided, and printing in the main scanning direction of the recording paper 616 is performed by ejecting inks from the heads 612K', 612C', 612M', 612Y'. When printing in one line in the main scanning direction has been completed, the recording paper 616 is moved by a prescribed amount in the sub-scanning direction, and the next printing action in the main scanning direction is carried out. By repeating this operation, it is possible to record an image onto the whole surface of the recording paper 616. Below, a mode which comprises full line type heads 612K, 612C, 612M and 612Y as shown in FIG. 28 is described.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged. In an inkjet recording apparatus based on a two-liquid system in which treatment liquid and ink are deposited on the recording paper 616, and the ink coloring material is caused to aggregate or become insoluble on the recording paper 616, thereby separating the ink solvent and the ink coloring material on the recording paper 616, it is possible to provide an inkjet head as a device for depositing the treatment liquid onto the recording paper 616.

It is preferable that a print determination unit is provided which includes an image sensor for capturing an image of the ink-droplet deposition result of the print unit 612 and which serves as a device to check for ejection abnormalities such as clogs of the nozzles from the ink-droplet deposition results evaluated by the image sensor.

For example, the print determination unit 24 of the present embodiment is configured with at least a line sensor having photoreceptor element rows with a width that is greater than the ink-droplet ejection width (image recording width) of the heads. This line sensor has a color separation line CCD sensor including a red (R) photoreceptor element row composed of photoelectric transducing elements (pixels) arranged in a line provided with an R filter, a green (G) photoreceptor element row with a G filter, and a blue (B) photoreceptor element row with a B filter. Instead of a line sensor, it is possible to use an area sensor composed of photoreceptor element which are arranged two-dimensionally.

The print determination unit determines the ejection from the respective heads by reading in a test pattern which has been printed by the heads of the respective colors. The ejection determination includes the presence of the ejection, measurement of the dot size, and measurement of the dot landing position.

As shown in FIG. 27, a post-drying unit 642 is provided after the print unit. The post-drying unit 642 is a device to dry the printed image surface, and includes a heating fan, for example. It is preferable to avoid contact with the printed surface until the printed ink dries, and a device that blows heated air onto the printed surface is preferable.

A heating and pressurizing unit 644 is provided at a stage following the after drying unit 642. The heating and pressurizing unit 644 is a device for controlling the luster of the image surface, and this unit applies pressure to the image surface by means of a pressurization roller 645 having a prescribed undulating surface, while heating the image surface, thereby transferring the undulating shape to the image surface.

When the recording paper 616 is pressed against the heating and pressurizing unit 644, then if, for instance, a dye-based ink has been printed onto a porous paper, this has the beneficial effect of increasing the weatherproofing of the image by closing the pores of the paper by pressurization, and thereby preventing the ink from coming into contact with elements which may cause the dye molecules to break down, such as ozone, or the like.

The printed matter generated in this manner is outputted from the paper output unit 626. The target print (i.e., the result of printing the target image) and the test print are preferably outputted separately. In the inkjet recording apparatus 600, a sorting device (not shown) is provided for switching the outputting pathways in order to sort the printed matter with the target print and the printed matter with the test print, and to send them to paper output units 626A and 626B, respectively. When the target print and the test print are simultaneously formed in parallel on the same large sheet of paper, the test print portion is cut and separated by a cutter (second cutter) 648. The cutter 648 is disposed directly in front of the paper output unit 626, and is used for cutting the test print portion from the target print portion when a test print has been performed in the blank portion of the target print. The structure of the cutter 648 is the same as the first cutter 628 described above, and has a stationary blade 648A and a round blade 648B.

Although not shown in FIG. 27, the paper output unit 626A for the target prints is provided with a sorter for collecting prints according to print orders.

Structure of the Head

Next, the structure of a head will be described. The heads of the respective ink colors have the same structure, and a reference numeral 650 is hereinafter designated to any of the heads.

FIG. 30A is a plan view perspective diagram which shows an example of the structure of the head 650, FIG. 30B is a plan view perspective diagram which shows a further example of the structure of the head 650 shown in FIG. 30A.

In order to achieve a high density of the dot pitch printed onto the surface of the recording paper 616, it is necessary to achieve a high density of the nozzle pitch in the head 650. The head 650 according to the present embodiment has a structure in which the nozzles 651 (pressure chamber 652) forming ink droplet ejection apertures are aligned in the main scanning direction, as shown in FIGS. 30A and 30B. Moreover, as shown in FIG. 30B, it is possible to reduce the effective nozzle pitch by one half by aligning two head units 650-1 and 650-2 in the sub-scanning direction and offsetting the two head units respectively by one half of the nozzle pitch between nozzles in the main scanning direction, and hence the nozzle arrangement density can be increased.

The pressure chamber 652 provided corresponding to each of the nozzles 651 is approximately square-shaped in plan view, and a nozzle 651 and a supply port (not illustrated) are provided in the center thereof. The respective pressure chambers 652 are each connected respectively via a supply port to the common liquid chamber 18 (see FIG. 1). The common liquid channel 18 is connected to an ink supply tank which forms an ink source (not shown in FIGS. 30A and 30B, and indicated by reference numeral 660 in FIG. 31). The ink supplied from the ink supply tank is distributed and supplied to the respective pressure chambers 652 via the common liquid chamber 18 in FIG. 1.

Configuration of an Ink Supply System

Figure 31:
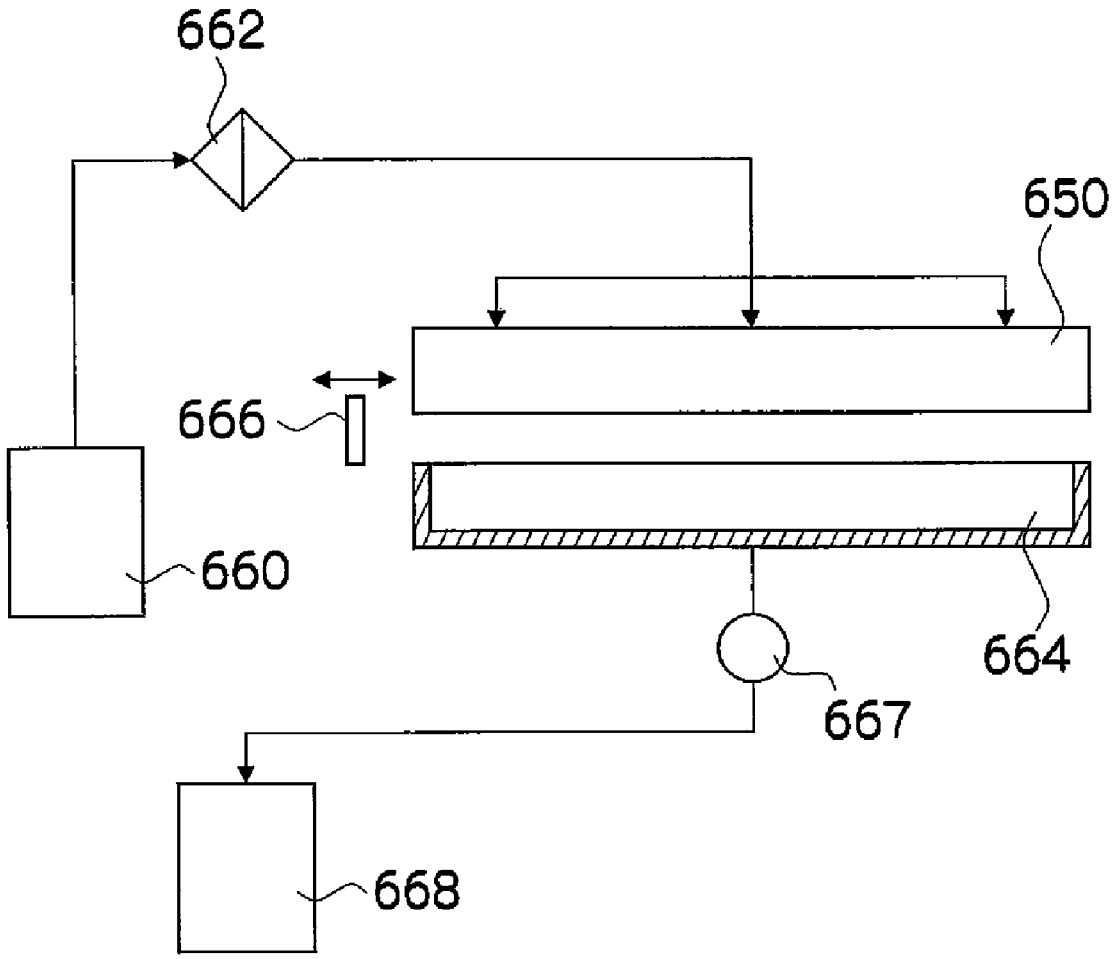
FIG. 31 is a conceptual diagram showing the composition of an ink supply system of the inkjet recording apparatus shown in FIG. 27.

FIG. 31 is a schematic drawing showing the configuration of the ink supply system in the inkjet recording apparatus 600. The ink supply tank 660 is a base tank that supplies ink to the head 650 and is included in the ink storing and loading unit 614 described with reference to FIG. 27. The aspects of the ink supply tank 660 include a refillable type and a cartridge type: when the remaining amount of ink is low, the ink supply tank 660 of the refillable type is filled with ink through a filling port (not shown) and the ink supply tank 660 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 662 for removing foreign matters and bubbles is disposed between the ink supply tank 660 and the head 650 as shown in FIG. 31. The filter mesh size in the filter 662 is preferably equivalent to or less than the diameter of the nozzle and commonly about 20 μm.

Figure 32:
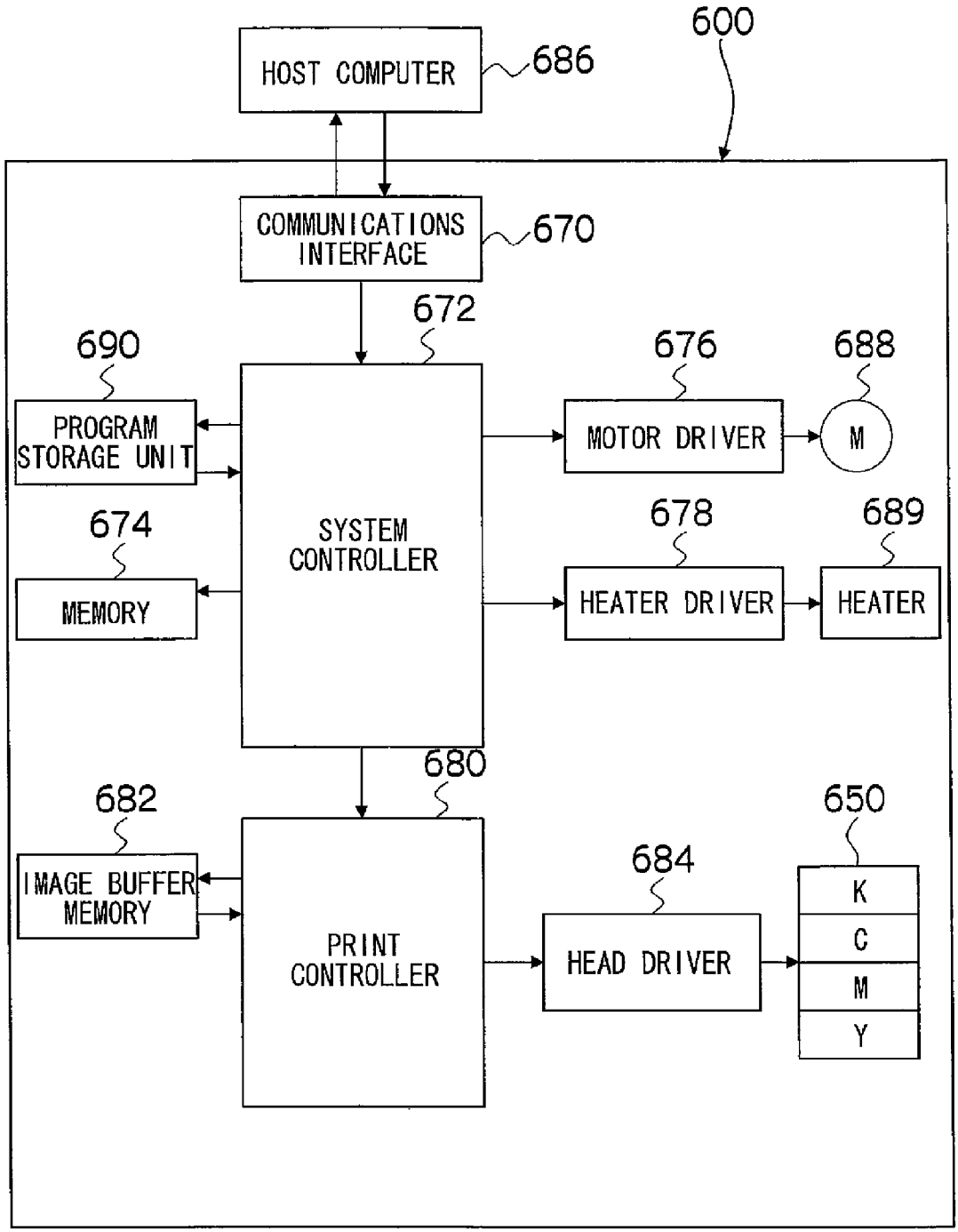
FIG. 32 is a conceptual diagram showing the composition of a control system of the inkjet recording apparatus shown in FIG. 27.

Although not shown in FIG. 32, it is preferable to provide a sub-tank integrally to the print head 650 or nearby the head 650. The sub-tank has a damper function for preventing variation in the internal pressure of the head and a function for improving refilling of the print head.

The inkjet recording apparatus 600 is also provided with a cap 664 as a device to prevent the nozzles 651 from drying out or to prevent an increase in the ink viscosity in the vicinity of the nozzles 651, and a cleaning blade 666 as a device to clean the nozzle face.

A maintenance unit including the cap 664 and the cleaning blade 666 can be relatively moved with respect to the head 650 by a movement mechanism (not shown), and is moved from a predetermined holding position to a maintenance position below the head 650 as required.

The cap 664 is displaced up and down relatively with respect to the head 650 by an elevator mechanism (not shown). When the power of the inkjet recording apparatus 600 is turned OFF or when in a print standby state, the cap 664 is raised to a predetermined elevated position so as to come into close contact with the head 650, and the nozzle face is thereby covered with the cap 664.

If the use frequency of a particular nozzle 651 is reduced and a nozzle continues in a state of not ejecting ink during a certain period of time or longer, during printing or during standby, then the ink solvent in the vicinity of the nozzle evaporates and the ink viscosity rises. When a nozzle assumes this state, then even if the heater (or piezoelectric element) forming the ejection energy generating device is operated, it is not possible to eject ink from the nozzle 651.

The heater is operated before the nozzles assume this state (while the viscosity is still within a range which enables ejection by operation of the heater), and a preliminary ejection (purge, blank ejection, spit ejection, dummy ejection) is performed toward a cap 664 (ink receptacle) in order to expel the degraded ink (ink in the vicinity of the nozzle which has increased in viscosity).

Moreover, when air bubbles enter into the ink inside the head 650 (inside the pressure chambers 652), it becomes impossible to eject ink from the nozzle, even if the heater is operated. In a case of this kind, a cap 664 is abutted against the head 650, the ink inside the pressure chamber 652 (the ink containing air bubbles) is removed by suctioning by a suctioning pump 667, and the ink removed by suctioning is supplied to the recovery tank 668.

This suctioning operation is also carried out to remove degraded ink of increased viscosity (solidified ink), whenever ink is filled into the head initially, or when the head starts to be used again after a prolonged idle period. Since the suctioning operation is carried out with respect to all of the ink inside the pressure chambers 652, then the amount of ink consumption becomes large. Consequently, a desirable mode is one in which preliminary ejection is carried out while the increase in the viscosity of the ink is small.

The cleaning blade 666 is composed of rubber or another elastic member, and can slide on the ink ejection surface (surface of nozzle plate) of the print head 650 by means of a blade movement mechanism (wiper). When ink droplets or foreign material become attached to the nozzle plate, the surface of the nozzle plate is wiped by sliding a cleaning blade 666 over the nozzle plate, thereby cleaning the surface of the nozzle plate. Preliminary ejection is carried out in order to prevent foreign material from entering into the nozzles 651 due to the action of the blade, when the soiling of the ink ejection surface is wiped by the blade mechanism.

Description of Control System

FIG. 32 is a principal block diagram showing the system configuration of the inkjet recording apparatus 600. The inkjet recording apparatus 600 comprises a communication interface 670, a system controller 672, a memory 674, a motor driver 676, a heater driver 678, a print control unit 680, an image buffer memory 682, a head driver 684, and the like.

The communication interface 670 is an interface unit for receiving image data sent from a host computer 686. A serial interface such as USB (Universal Serial Bus), IEEE1394, Ethernet (registered trademark), wireless network, or a parallel interface such as a Centronics interface may be used as the communication interface 670. A buffer memory (not shown) may be mounted in this portion in order to increase the communication speed. The image data sent from the host computer 686 is received by the inkjet recording apparatus 600 through the communication interface 670, and is temporarily stored in the memory 674.

The memory 674 is a storage device for temporarily storing images inputted through the communication interface 670, and data is written and read to and from the memory 674 through the system controller 672. The memory 674 is not limited to a memory composed of semiconductor elements, and a hard disk drive or another magnetic medium may be used.

The system controller 672 is constituted by a central processing unit (CPU) and peripheral circuits thereof and the like, and it functions as a control device for controlling the whole of the inkjet recording apparatus 600 in accordance with a prescribed program, as well as a calculation device for performing various calculations. More specifically, the system controller 672 controls the various sections, such as the communication interface 670, memory 674, motor driver 676, heater driver 678, and the like, as well as controlling communications with the host computer 686 and writing and reading to and from the memory 674, and it also generates control signals for controlling the motor 688 and heater 689 of the conveyance system.

The program executed by the CPU of the system controller 672 and the various types of data which are required for control procedures are stored in the memory 674. The memory 674 may be a non-writeable storage device, or it may be a rewriteable storage device, such as an EEPROM. The memory 674 is used as a temporary storage region for the image data, and it is also used as a program development region and a calculation work region for the CPU.

The motor driver 676 is a driver which drives the motor 688 in accordance with instructions from the system controller 672. In FIG. 32, the motors (actuators) disposed in the respective sections of the apparatus are represented by the reference numeral 88. For example, the motor 688 shown in FIG. 32 includes a motor which drives the drum 31 (32) in FIG. 27, a motor of the movement mechanism which moves the cap 664 in FIG. 31, a motor of the movement mechanism which moves the cleaning blade 666 in FIG. 31, and the like.

The heater driver 678 is a driver which drives heaters 689, including a heater forming a heat source of the heating fan 640 shown in FIG. 27, a heater of the post drying unit 642, and the like, in accordance with instructions from the system controller 672.

The print controller 680 has a signal processing function for performing various tasks, compensations, and other types of processing for generating print control signals from the image data stored in the memory 674 in accordance with commands from the system controller 672 so as to supply the generated print data (dot data) to the head driver 684. Prescribed signal processing is carried out in the print controller 680, and the ejection amount and the ejection timing of the ink droplets from the respective print heads 650 are controlled via the head driver 684, on the basis of the print data. By this means, prescribed dot size and dot positions can be achieved.

The print controller 680 is provided with the image buffer memory 682; and image data, parameters, and other data are temporarily stored in the image buffer memory 682 when image data is processed in the print controller 680. Also possible is an aspect in which the print controller 680 and the system controller 672 are integrated to form a single processor.

The head driver 684 generates drive signals to be applied to the heaters (piezoelectric elements) of the head 650, on the basis of image data supplied from the print controller 680, and also comprises drive circuits which drive the heaters by applying the drive signals to the heaters. A feedback control system for maintaining constant drive conditions in the head may be included in the head driver 684 shown in FIG. 32.

The image data to be printed is externally inputted through the communication interface 670, and is stored in the memory 674. In this stage, the RGB image data is stored in the memory 674.

The image data stored in the memory 674 is sent to the print controller 680 through the system controller 672, and is converted to the dot data for each ink color, in the print controller 680. In other words, the print controller 680 performs processing for converting the inputted RGB image data into dot data for four colors, K, C, M and Y. The dot data generated by the print controller 680 is stored in the image buffer memory 682.

Various control programs are stored in the program storage unit 690, and a control program is read out and executed in accordance with commands from the system controller 672. The program storage unit 690 may use a semiconductor memory, such as a ROM, EEPROM, or a magnetic disk, or the like. An external interface may be provided, and a memory card or PC card may also be used. Naturally, a plurality of these recording media may also be provided. The program storage unit 690 may also be combined with a storage device for storing operational parameters, and the like (not illustrated).

In the present embodiment, an inkjet recording apparatus which forms a color image on a recording medium was described as an example of the apparatus according to an embodiment of the present invention, but the present invention can also be applied broadly to other liquid ejection apparatuses, such as a dispenser.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

an ejection port through which liquid is ejected;

a liquid chamber which is connected to the ejection port, the liquid chamber being filled with the liquid;

a heating device which is arranged on a wall of the liquid chamber, the heating device heating the liquid in the liquid chamber so as to generate a bubble in the liquid and to cause growth of the bubble; and a movable member which has a free end on a side of the ejection port and a fixed end on a side opposite to the ejection port, the free end being arranged at a prescribed distance from the wall of the liquid chamber so as to face the wall of the liquid chamber and to be moved by pressure applied by the growth of the bubble, the movable member including a first layer that is an internal layer, and second and third layers that are respectively arranged on both surfaces of the first layer, the second and third layers having a stress lower than the first layer.

2. The liquid ejection head as defined in claim 1, wherein the stress of the first layer is a tensile stress, and the stress of the second and third layers is a compressive stress.

3. The liquid ejection head as defined in claim 1, wherein the first layer of the movable member is embedded in the second and third layers.

4. The liquid ejection head as defined in claim 1, wherein a surface of the movable member that makes contact with the liquid in the liquid chamber is covered with a liquid resistant film.

5. The liquid ejection head as defined in claim 1, further comprising a restricting member which supports a movable portion of the movable member from a side of the wall on which the heating device is arranged, the movable portion including the free end of the movable member.

6. The liquid ejection head as defined in claim 1, further comprising a fixing member which is arranged between the fixed end of the movable member and the wall of the liquid chamber, the movable member having a flat-plate shape, the fixed end of the movable member being fixed to the wall by means of the fixing member.

7. A liquid ejection apparatus comprising the liquid ejection head as defined in claim 1.

8. The liquid ejection head as defined in claim 1, wherein the free end of the movable member that has been moved by the pressure applied by the growth of the bubble returns when the bubble is caused to extinguish.

9. The liquid ejection head as defined in claim 1, wherein a stress differential between the first layer and the second layer is not less than 50 MPa and not greater than 500 MPa.

10. The liquid ejection head as defined in claim 1, wherein a stress differential between the first layer and the third layer is not less than 50 MPa and not greater than 500 MPa.

11. A liquid ejection head, comprising:

an ejection port through which liquid is ejected;

a liquid chamber which is connected to the ejection port, the liquid chamber being filled with the liquid;

a pressurization device which is arranged on a wall of the liquid chamber, the pressurization device pressurizing the liquid in the liquid chamber; and a movable member which has a free end on a side of the ejection port and a fixed end on a side opposite to the ejection port, the free end being arranged at a prescribed distance from the wall of the liquid chamber so as to face the wall of the liquid chamber, the movable member including a first layer that is an internal layer, and second and third layers that are respectively arranged on both surfaces of the first layer, the second and third layers having a stress lower than the first layer, wherein the stress in the second and third layers decreases from a side of the first layer toward a side opposite to the first layer.

12. A liquid ejection head, comprising:

an ejection port through which liquid is ejected;

a liquid chamber which is connected to the ejection port, the liquid chamber being filled with the liquid;

a pressurization device which is arranged on a wall of the liquid chamber, the pressurization device pressurizing the liquid in the liquid chamber; and a movable member which has a free end on a side of the ejection port and a fixed end on a side opposite to the ejection port, the free end being arranged at a prescribed distance from the wall of the liquid chamber so as to face the wall of the liquid chamber, the movable member including a first layer that is an internal layer, and second and third layers that are respectively arranged on both surfaces of the first layer, the second and third layers having a stress lower than the first layer, wherein at least one of the second and third layers includes a plurality of layers that are stacked together, adjacent two layers of the plurality of layers satisfying conditions that one of the adjacent two layers farther from the first layer has a stress lower than the other of the adjacent two layers nearer to the first layer.

13. A liquid ejection head, comprising:

an ejection port through which liquid is ejected;

a liquid chamber which is connected to the ejection port, the liquid chamber being filled with the liquid;

a pressurization device which is arranged on a wall of the liquid chamber, the pressurization device pressurizing the liquid in the liquid chamber; and a movable member which has a free end on a side of the ejection port and a fixed end on a side opposite to the ejection port, the free end being arranged at a prescribed distance from the wall of the liquid chamber so as to face the wall of the liquid chamber, the movable member including a first layer that is an internal layer, and second and third layers that are respectively arranged on both surfaces of the first layer, the second and third layers having a stress lower than the first layer, wherein:

one of the second and third layers that is nearer to the wall on which the pressurization device is arranged has a stress greater than the other of the second and third layers; and the free end of the movable member bends toward the wall on which the pressurization is arranged, in an initial state.

14. A liquid ejection head, comprising:

an ejection port through which liquid is ejected;

a liquid chamber which is connected to the ejection port, the liquid chamber being filled with the liquid;

a pressurization device which is arranged on a wall of the liquid chamber, the pressurization device pressurizing the liquid in the liquid chamber; and a movable member which has a free end on a side of the ejection port and a fixed end on a side opposite to the ejection port, the free end being arranged at a prescribed distance from the wall of the liquid chamber so as to face the wall of the liquid chamber, the movable member including a first layer that is an internal layer, and second and third layers that are respectively arranged on both surfaces of the first layer, the second and third layers having a stress lower than the first layer, wherein one of the second and third layers that is nearer to the wall on which the pressurization device is arranged has a structure in which the stress decreases from a side of the free end toward a side of the fixed end.

15. A liquid ejection head, comprising:

an ejection port through which liquid is ejected;

a liquid chamber which is connected to the ejection port, the liquid chamber being filled with the liquid;

a pressurization device which is arranged on a wall of the liquid chamber, the pressurization device pressurizing the liquid in the liquid chamber; and a movable member which has a free end on a side of the ejection port and a fixed end on a side opposite to the ejection port, the free end being arranged at a prescribed distance from the wall of the liquid chamber so as to face the wall of the liquid chamber, the movable member including a first layer that is an internal layer, and second and third layers that are respectively arranged on both surfaces of the first layer, the second and third layers having a stress lower than the first layer, wherein the movable member includes a fixed portion corresponding to the fixed end which is fixed directly to the wall on which the pressurization device is arranged, an inclined portion which rises from the fixed portion toward a side of the free end, and a movable portion which extends from the inclined portion toward the free end, the movable portion being arranged at a prescribed distance from the wall on which the pressurization device is arranged.

16. A method of manufacturing a liquid ejection head which includes: an ejection port through which liquid is ejected; a liquid chamber which is connected to the ejection port, the liquid chamber being filled with the liquid; a heating device which is arranged on a wall of the liquid chamber, the heating device heating the liquid in the liquid chamber so as to generate a bubble in the liquid and to cause growth of the bubble; and a movable member which has a free end on a side of the ejection port and a fixed end on a side opposite to the ejection port, the free end being arranged at a prescribed distance from the wall of the liquid chamber so as to face the wall of the liquid chamber and to be moved by pressure applied by the growth of the bubble, the movable member including a first layer that is an internal layer, and second and third layers that are respectively arranged on both surfaces of the first layer, the method comprising the steps of:

forming the third layer;

then forming the first layer on the third layer on a side opposite to the wall on which the heating device is arranged, the first layer having a stress higher than the third layer; and then forming the second layer on the first layer on a side opposite to the third layer, the second layer having a stress lower than the first layer.

17. The method of manufacturing a liquid ejection head as defined in claim 16, wherein the first to third layers are formed by a thin film formation process including at least one of plating, sputtering and CVD.

* * * * *